US010577856B2

(12) United States Patent
Briese et al.

(10) Patent No.: US 10,577,856 B2
(45) Date of Patent: Mar. 3, 2020

(54) AUTOMATED SPACER FRAME FABRICATION AND METHOD

(71) Applicant: GED Integrated Solutions, Inc., Twinsburg, OH (US)

(72) Inventors: William Briese, Hinckley, OH (US); John Grismer, Cuyahoga Falls, OH (US); Paul A. Hofener, Parma, OH (US)

(73) Assignee: GED Integrated Solutions, Inc., Twinsburg, OH (US)

( * ) Notice: Subject to any disclaimer, the term of this patent is extended or adjusted under 35 U.S.C. 154(b) by 263 days.

(21) Appl. No.: 15/665,625

(22) Filed: Aug. 1, 2017

(65) Prior Publication Data

US 2017/0328120 A1 Nov. 16, 2017

Related U.S. Application Data

(62) Division of application No. 14/198,706, filed on Mar. 6, 2014, now Pat. No. 9,765,564.

(Continued)

(51) Int. Cl.

*E06B 3/663* (2006.01)
*E06B 3/673* (2006.01)

(Continued)

(52) U.S. Cl.

CPC ..... *E06B 3/663* (2013.01); *B21D 28/22* (2013.01); *E06B 3/67304* (2013.01);

(Continued)

(58) Field of Classification Search

CPC ..... B21D 5/08; B21D 28/002; B21D 28/10; B21D 28/22; B21D 28/24; B21D 28/243;

(Continued)

(56) References Cited

U.S. PATENT DOCUMENTS 3,318,235 A 5/1967 Hanni
3,333,447 A 8/1967 Alspaugh (Continued)

FOREIGN PATENT DOCUMENTS

EP 0770754 5/1997

OTHER PUBLICATIONS

Extended Supplementary European Search Report dated Sep. 15, 2016 for European Patent Application No. 14774860.2, filed Mar. 7, 2014. (8 pages).

(Continued)

*Primary Examiner* — Peter Dungba Vo
*Assistant Examiner* — Joshua D Anderson
(74) *Attorney, Agent, or Firm* — John A. Yirga, Esq.; Tarolli, Sundheim, Covell & Tummino LLP

(57) ABSTRACT

Method and Apparatus for fabricating a spacer frame for use in an insulating glass unit. One of a multiple number of possible spacer frame materials is chosen for the spacer frame. An elongated strip of the material is moved to a notching station where notches are formed at corner locations. The character of the notches is adjusted based on the selection of the metal strip material and more particularly to achieve bending of the material in an repeatable, straightforward manner. Downstream from the notching station the metal strip is bent into a channel shaped elongated frame member having side walls. Further downstream a leading strip of channel shaped material is severed or separated from succeeding material still passing through the notching and bending station.

26 Claims, 27 Drawing Sheets

Related U.S. Application Data

(60) Provisional application No. 61/782,774, filed on Mar. 14, 2013.

(51) Int. Cl.

| | |
|---|---|
| ***B21D 53/74*** | (2006.01) |
| ***B21D 28/22*** | (2006.01) |
| *B30B 15/00* | (2006.01) |
| *B21D 28/00* | (2006.01) |

(52) U.S. Cl.
CPC ..... *E06B 3/67308* (2013.01); *E06B 3/67313* (2013.01); *B21D 28/002* (2013.01); *B21D 53/74* (2013.01); *B30B 15/0029* (2013.01)

(58) Field of Classification Search
CPC .... B21D 28/26; B21D 28/265; B21D 28/346; B21D 53/74; B21D 53/745; B30B 15/0029; Y10T 29/49798; E06B 3/663; E06B 3/673; E06B 3/67304; E06B 3/67308; E06B 3/67313
See application file for complete search history.

(56) References Cited

U.S. PATENT DOCUMENTS

| | | | | |
|---|---|---|---|---|
| 4,377,084 | A | | 3/1983 | Kaminski |
| 5,269,163 | A | * | 12/1993 | Yagi ..... B30B 15/0041 100/99 |
| 5,295,292 | A | | 3/1994 | Leopold |
| 5,361,476 | A | | 11/1994 | Leopold |
| 6,678,938 | B2 | | 1/2004 | McGlinchy et al. |
| 7,448,246 | B2 | | 11/2008 | Briese et al. |
| 7,610,681 | B2 | | 11/2009 | Calcei et al. |
| 8,720,026 | B2 | | 5/2014 | McGlinchy |
| 9,279,283 | B2 | | 3/2016 | Briese et al. |
| 9,765,564 | B2 | | 9/2017 | Briese et al. |

OTHER PUBLICATIONS

International Search Report dated Jul. 8, 2014 and Written Opinion of the International Searching Authority dated Jul. 8, 2014 for PCT International Application No. PCT/US2014/21741, claims priority from the U.S. Appl. No. 14/198,706 now U.S. Pat. 9,765,564 and U.S. Appl. No. 61/782,774. (9 pages).

* cited by examiner

AUTOMATED SPACER FRAME FABRICATION AND METHOD

CROSS REFERENCES TO RELATED APPLICATIONS

The following application is a non-provisional divisional patent application claiming priority under 35 USC sec 119 to co-pending U.S. non provisional patent application Ser. No. 14/198,706 filed Mar. 6, 2014 entitled AUTOMATED SPACER FRAME FABRICATION AND METHOD, which claims priority under 35 USC sec 119(e) to U.S. Provisional application Ser. No. 61/782,774 filed on Mar. 14, 2013 entitled AUTOMATED SPACER FRAME FABRICATION AND METHOD. The above two patent applications are incorporated herein by reference in their entireties and claims priority therefrom for all purposes.

TECHNICAL FIELD

The present disclosure relates to a method and apparatus for fabricating a spacer frame for use in making a window or door.

BACKGROUND

Insulating glass units (IGUs) are used in windows and doors to reduce heat loss from building interiors during cold weather. IGUs are typically formed by a spacer assembly sandwiched between glass lites. A spacer assembly has a frame structure extending peripherally about the insulating glass unit. A sealant material bonds the glass lites to the frame structure and a desiccant for absorbing atmospheric moisture within the unit, trapped between the lites. The margins or the glass lites are flush with or extend slightly outwardly from the spacer assembly. The sealant extends continuously about the frame structure periphery and its opposite sides so that the space within the IGUs is hermetic.

U.S. Pat. No. 5,361,476 to Leopold discloses a method and apparatus for making IGUs wherein a thin flat strip of sheet material is continuously formed into a channel shaped spacer frame having corner structures and end structures, the spacer thus formed is cut off, sealant and desiccant are applied and the assemblage is bent to form a spacer assembly.

U.S. Pat. No. 7,610,681 to Calcei et al, (hereinafter "the '681 Patent") concerns spacer frame manufacturing equipment wherein a stock supply station includes a number of rotatable sheet stock coils, an indexing mechanism for positioning one of the coils, and an uncoiling mechanism. Multiple other processing stations act on the elongated strip of sheet stock uncoiled from the stock supply station. The disclosure of the '681 Patent is incorporated herein by reference.

U.S. Pat. No. 7,448,246 to Briese et al. (hereinafter "the 246 Patent") concerns another spacer frame manufacturing system. As discussed in the '246 Patent, spacer frames depicted are initially formed as a continuous straight channel constructed from a thin ribbon of stainless steel material e.g., 304 stainless steel having a thickness of 0.006-0.010 inches. As noted, other materials such as galvanized, tin plated steel, or aluminum can be used to construct the spacer frame. The disclosure of the '246 Patent to Briese et al is also incorporated herein by reference. Typical thickness for these other materials range from 0.006 to 0.025 inches in thickness.

U.S. pending patent application Ser. No. 13/364,848 published as US 2012/0011722 A1 discloses a system for forming spacer frames from one of a multiple number of possible spacer frame materials. The contents of this pending patent application are incorporated by reference in their entirety for all purposes.

SUMMARY

A disclosed system and method fabricates window components such as a spacer frame used in making an insulating glass unit. One of a multiple number of possible materials is chosen from which to make the window component. An elongated strip of the chosen material is moved to a notching station where notches are formed at corner locations. The character of the notches is adjusted based on the selection of the strip material and more particularly to achieve bending of the material at the corner locations in an repeatable, attractive manner. Downstream from the notching station in the example of a spacer frame, the strip is bent into a channel shaped elongated frame member having side walls. Further downstream a leading portion of channel shaped material that forms a forwardmost spacer frame is severed or separated from succeeding material still passing through the notching and bending stations.

One system produces different width spacer frames by using different width strip material. The corner locations are formed before the strip is roll formed into a channel shape by a die and anvil pair appropriately positioned (by appropriate side movement with respect to a strip path of travel) on opposite sides of the strip. A punch moves the die into contact with the strip to remove part of the strip and to deform in a controlled way a part of the strip near the removed portion.

These and other features of the disclosure will become more fully understood by a review of a description of an exemplary system when reviewed in conjunction with the accompanying drawings.

BRIEF DESCRIPTION OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals refer to like parts unless described otherwise throughout the drawings and in which.

DETAILED DESCRIPTION

Figure 1:
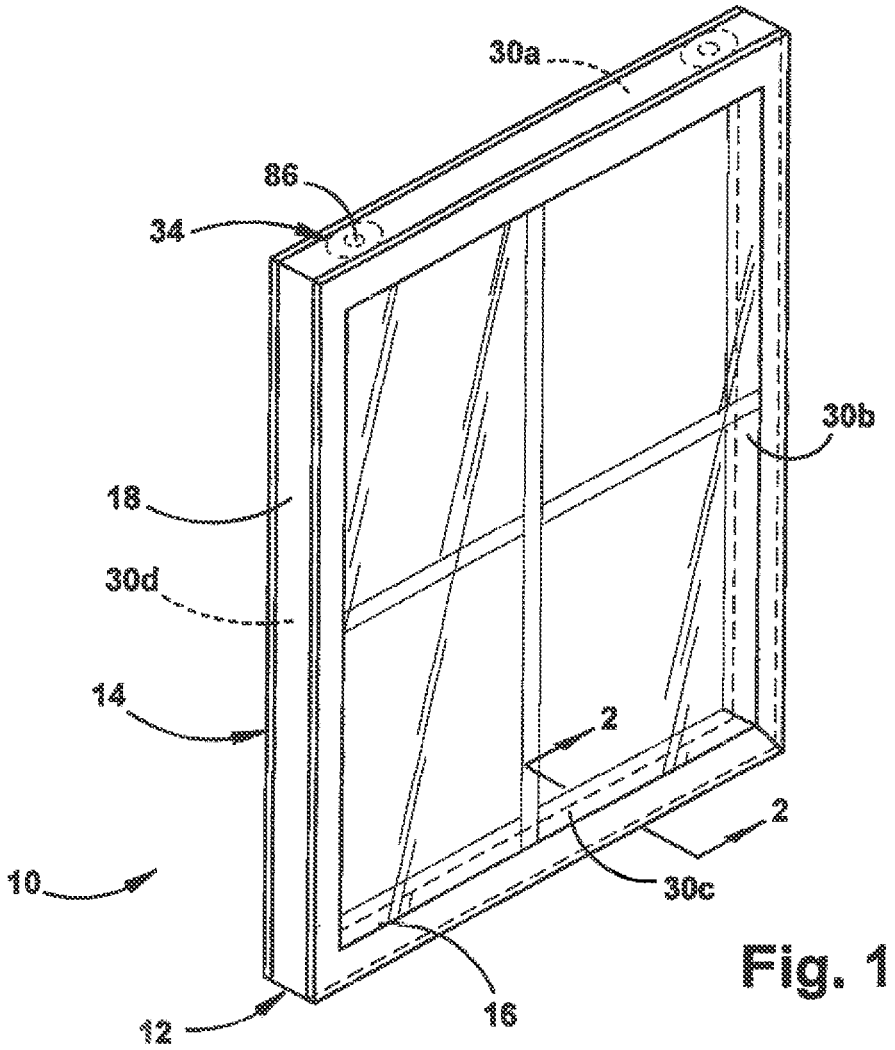
FIG. 1 is a perspective view of an insulating glass unit.

Referring now to the figures generally wherein like numbered features shown therein refer to like elements throughout unless otherwise noted. The present disclosure provides both a method and apparatus for fabricating a spacer frame for use in making a window or door. More specifically, the drawing Figures and specification disclose a method and apparatus for producing elongated spacer frames used in making insulating glass units. The method and apparatus are embodied in a production line that forms material into spacer frames for completing the construction of insulating glass units. While an exemplary system fabricates metal frames, the disclosure can be used with plastic frame material extruded into elongated sections having corner notches.

IGUs

Figure 2:
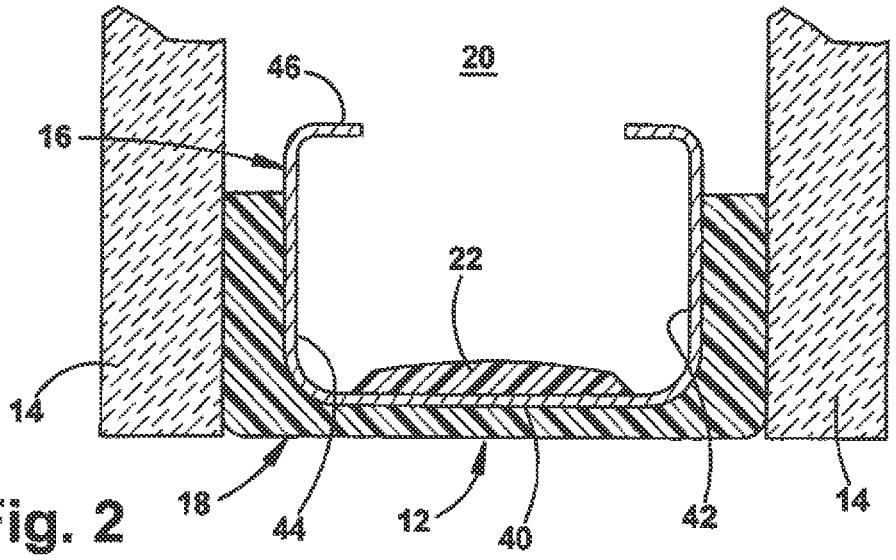
FIG. 2 is section view as seen from the plane 2-2 of FIG. 1.

An insulating glass unit (IGU) 10 is illustrated in FIG. 1. The IGU 10 includes a spacer assembly 12 sandwiched between glass sheets, or lites, 14 (FIG. 2). The assembly 12 comprises a frame structure 16 and sealant material 18 for hermetically joining the frame to the lites to form a closed space 20 within the unit 10. The unit 10 is illustrated in FIG. 1 as in condition for final assembly into a window or door frame, not illustrated, for ultimate installation in a building. The unit 10 illustrated in FIG. 1 includes muntin bars that provide the appearance of individual window panes.

The assembly 12 maintains the lites 14 spaced apart from each other to produce a hermetic insulating space 20 between them. The frame 16 and the sealant body 18 co-act to provide a structure which maintains the lites 14 properly assembled with the space 20 sealed from atmospheric moisture over long time periods during which the unit 10 is subjected to frequent significant thermal stresses. A desiccant 22 removes water vapor from air, or other volatiles, entrapped in the space 20 during construction of the unit 10.

The sealant 18 both structurally adheres the lites 14 to the spacer assembly 12 and hermetically closes the space 20 against infiltration of airborne water vapor from the atmosphere surrounding the unit 10. One suitable sealant 18 is formed from a "hot melt" material which is attached to the frame 16 sides and outer periphery to form a U-shaped cross section.

Figure 3:
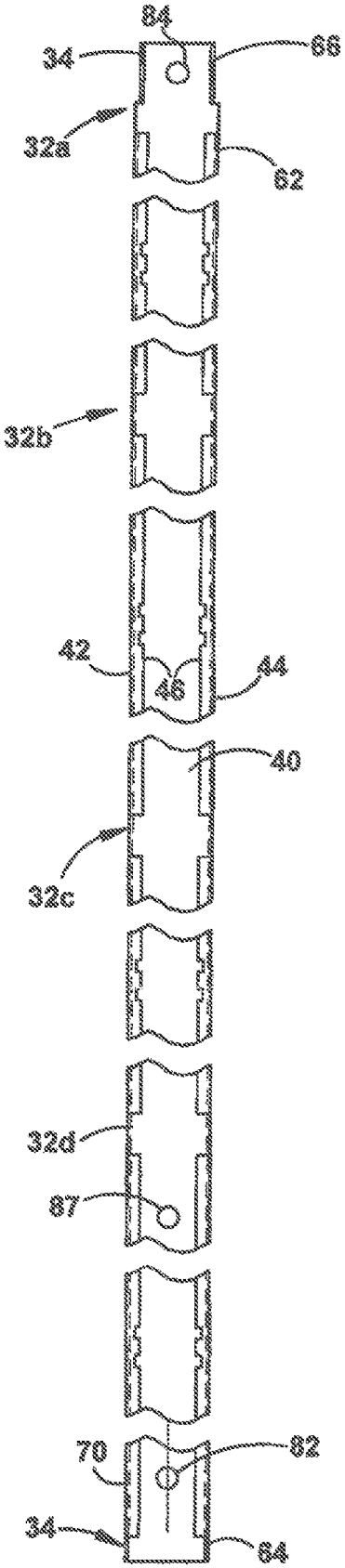
FIGS. 3 and 4 are top and side views of a spacer frame (prior to being folded into a closed-multi-sided frame) that forms part of the FIG. 1 insulating glass unit.

The frame 16 extends about the unit's periphery to provide a structurally strong, stable spacer 12 for maintaining the lites 14 aligned and spaced while minimizing heat conduction between the lites via the frame. The preferred frame 16 comprises a plurality of spacer frame segments, or members, 30*a-d* connected to form a planar, polygonal frame shape, element juncture forming frame corner structures 32*a-d*, and connecting structure 34 (FIG. 3) for joining opposite frame element ends to complete the closed frame shape.

The preferred frame 16 is elongated and has a channel shaped cross section defining a peripheral wall 40 and first and second lateral walls 42, 44. See FIG. 2. The peripheral wall 40 extends continuously about the unit 10 except where the connecting structure 34 joins the two frame member ends. The lateral walls 40, 42 extend inwardly from the peripheral wall 40 in a direction parallel to the planes of the lites 14 and the frame 16. The illustrated frame 16 has stiffening flanges 46 formed along the inwardly projecting lateral wall edges. The lateral walls 42, 44 add rigidity to the frame member 30 so it resists flexure and bending in a direction transverse to its longitudinal extent. The flanges 46 stiffen the walls 42, 44 so they resist bending and flexure transverse to their longitudinal extents.

Figure 4:
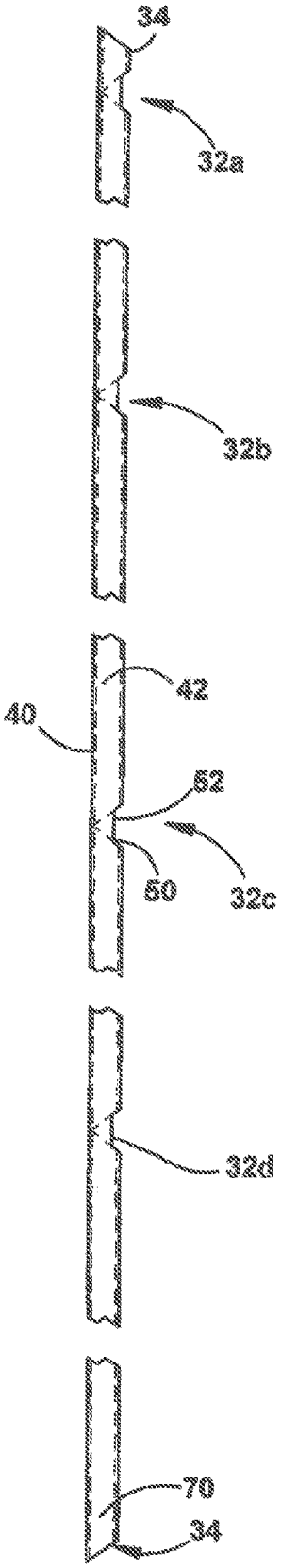

The frame 16 is initially formed as a continuous straight channel constructed from a thin ribbon of material. As described more fully below, the corner structures 32*a*-32*d* are made to facilitate bending the frame channel to the final, polygonal frame configuration in the unit 10 while assuring an effective vapor seal at the frame corners. A sealant is applied and adhered to the channel before the corners are bent. The corner structures initially comprise notches 50 and weakened zones 52 formed in the walls 42, 44 at frame corner locations. See FIG. 4. The notches 50 extend into the walls 42, 44 from the respective lateral wall edges. The lateral walls 42, 44 extend continuously along the frame 16 from one end to the other. The walls 42, 44 are weakened at the corner locations because the notches reduce the amount of lateral wall material and eliminate the stiffening flanges 46 and because the walls are stamped or coined to weaken them at the corners.

At the same time the notches 50 are formed, the weakened zones 52 are formed. These weakened zones 52 are cut into the strip, but not all the way through. The connecting structure 34 secures the opposite frame ends 62, 64 together when the frame 16 has been bent to its final configuration. The illustrated connecting structure comprises a connecting tongue structure 66 continuous with and projecting from the frame structure end 62 and a tongue receiving structure 70 at the other frame end 64. The preferred tongue and tongue receiving structures 66, 70 are constructed and sized relative to each other to form a telescopic joint. When assembled, the telescopic joint maintains the frame 16 in its final polygonal configuration prior to assembly of the unit 10.

The Production Line 100

Figure 5:
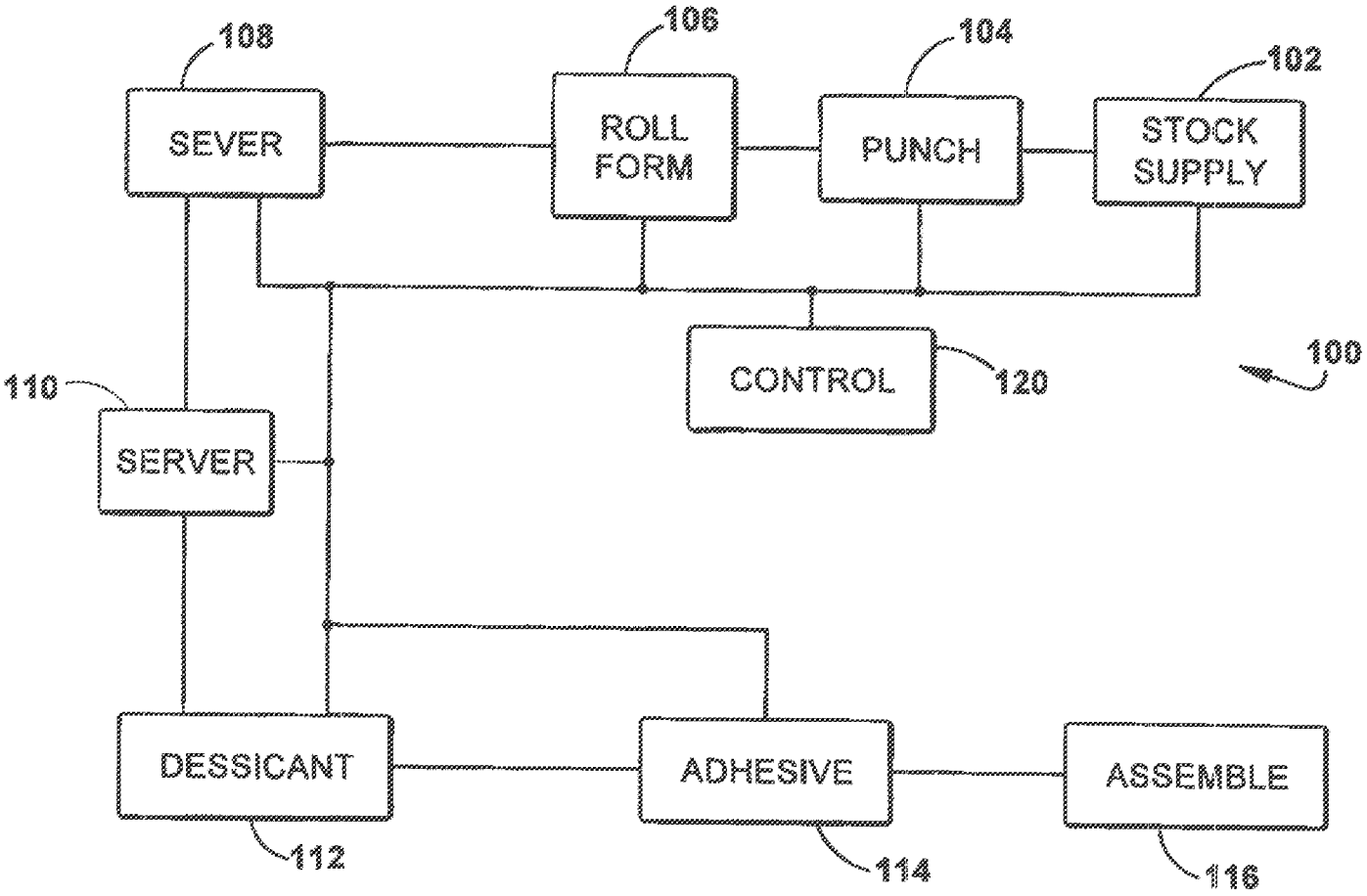
FIG. 5 is a schematic depiction of a production line for use with the invention.

As indicated previously the spacer assemblies 12 are elongated window components that may be fabricated by using the method and apparatus of the present invention. Elongated window components are formed at high rates of production. The operation by which elongated window components are fashioned is schematically illustrated in FIG. 5 as a production line 100 through which a thin, relatively narrow ribbon of sheet metal stock is fed endwise from a coil into one end of the assembly line and substantially completed elongated window components emerge from the other end of the line 100.

The line 100 comprises a stock supply station 102, a punching station 104, a roll forming station 106, a crimper station 108, and a severing station 110 where partially formed spacer w members are separated from the leading end of the stock. At a desiccant application station 112 desiccant is applied to an interior region of the spacer frame member. At an extrusion station 114 sealant is applied to the yet to be folded frame member. A scheduler/motion controller unit 120 interacts with the stations and loop feed sensors to govern the spacer stock size, spacer assembly size, the stock feeding speeds in the line, and other parameters involved in production. At an assembly station 116, the glass lites are affixed to the frame and sent to an oven for curing.

Figure 6:
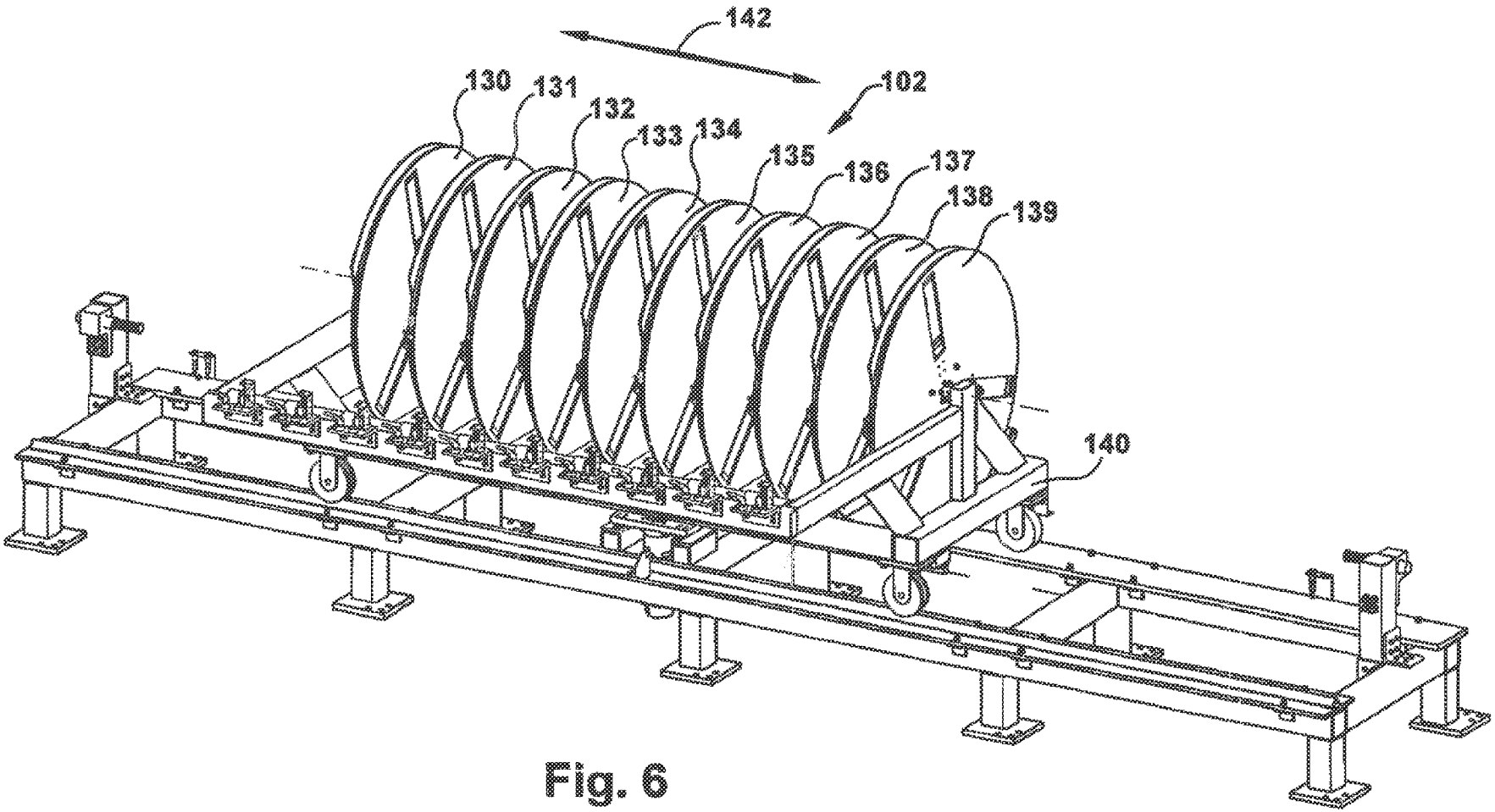
FIG. 6 is a perspective view of a stock supply station.

As described more fully in the Calcei et al. patent, elongated coils 130-139 (FIG. 6) are supported to a carriage 140 for back and forth movement in the direction of the double ended arrow 142. One of the multiple coils is moved by the controller 120 to an uncoiling position for delivering a selected strip of sheet stock material to the downstream stations depicted in FIG. 5.

The scheduler/motion controller unit 120 interacts with the stations and loop feed sensors to govern the spacer stock size, spacer assembly size, the stock feeding speeds in the line, and other parameters involved in production. A preferred controller unit 120 is commercially available from Delta Tau, 21314 Lassen St, Chatsworth, Calif. 91311 as part number UMAC.

The Punching Station 104

Figure 11:
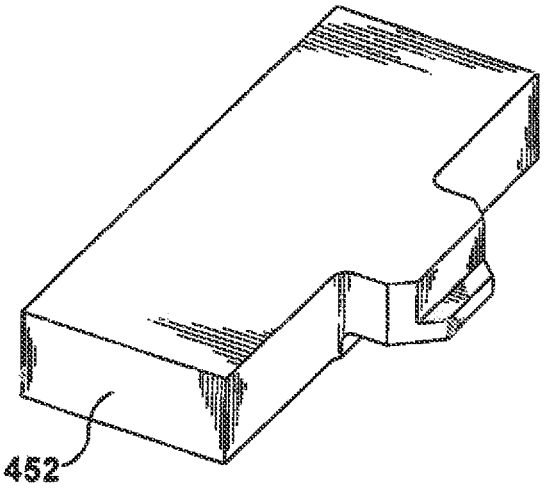
FIGS. 11, 11A, 12, and 12A are perspective views of a die set including a punching die and a deformation die.
Figure 11A:
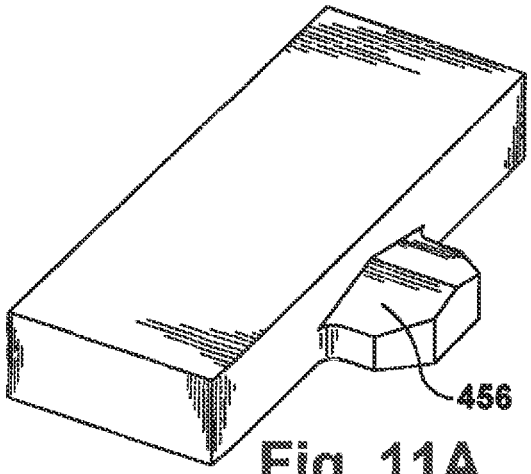

The punching station 104 accepts the stock S from a properly positioned coil at the stock supply station and performs a series of stamping operations on the stock as the stock S passes through the punching station. The punching station 104 comprises a supporting framework 238 (FIG. 11) fixed to the factory floor. A stock driving system 140 moves the stock through the station until the stock is grasped by a downstream drive system 145 (FIG. 11) described in more detail in the Calcei et al. '681 Patent. Stamping units 144, 146, 148, 150, 152, 154 spaced along the station 104 in the direction of stock movement perform individual stamping operations on the stock S.

The illustrated stock driving system 140 includes a pair of rollers 156, 158 secured to the framework at an entrance to the punching station 104. The rollers 156, 158 are selectively moveable between a disengaged position in which the drive rollers are spaced apart and an engaged position in which the drive rollers engage an end portion of the strip S at the entrance of the punching station 104. The rollers 156, 158 selectively feed the sheet stock into the punching station 104.

In the illustrated embodiment, a drive roller 156 is selectively driven by a motor coupled to a drive shaft 162 that is controlled by the controller 120. An idle roller 158 is pivotally connected to its support framework. In the illustrated embodiment, the roller 158 is an idler roller that presses the sheet stock S against the roller 156 when the drive roller 156 is in the engaged position. The motor is controlled to feed the sheet stock through the station 104. In the illustrated embodiment, a sensor is positioned along the path of travel near the stamping station and creates an output for verifying that stock S is being fed.

The controller moves the pair of rollers 156, 158 to the disengaged, spaced apart position and indexes or moves an appropriate or selected sheet stock coil from the plurality of coils 130-439. At the uncoiling position, a feed mechanism positions the sheet stock end portion between the pair of rollers 156, 158. The controller 120 moves the pair of rollers 156, 158 to the engagement position to engage the coil end portion, and rotates the drive roller to feed the sheet stock into the punching station. In one embodiment, the stock driving system 140 is also used to withdraw stock from the stamping station 104 when strip stock of a different thickness, width or material is to fabricated into spacer frames.

In the disclosed system, a stock driving system 145 on an output side of the punching station 104 engages the stock provided by the stock driving system 140. The stock driving system 140 then disengages. The subsequent downstream drive system 145 has rolls that define a nip for securely gripping the stock and pulling it through the station 104 past a number of stamping units 144, 146, 148, 148', 150, 150', 152, 154. The downstream drive system includes an electric servomotor to start and stop with precision. Accordingly, stock passes through the station 104 at precisely controlled speeds and stops precisely at predetermined locations, all depending on signals from the controller 120.

Each stamping unit 144, 146, 148, 150, 152, 154 comprises a die assembly and a die actuator assembly, or ram assembly. Each die assembly comprises a die set having a lower die, or anvil, beneath the stock travel path and an upper die, or hammer, above the travel path. The stock passes between the dies as it moves through the station 104. Each hammer is coupled to its respective ram assembly. Each ram assembly forces its associated dies together with the stock between them to perform a particular stamping operation on the stock.

Figure 22:
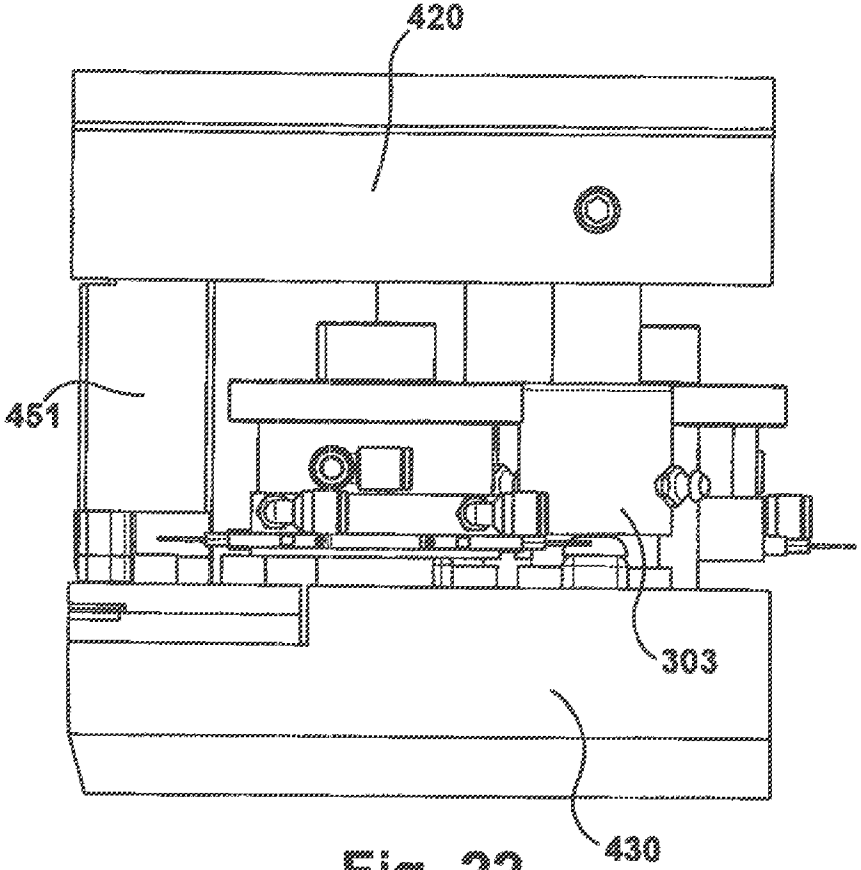
Figure 24:
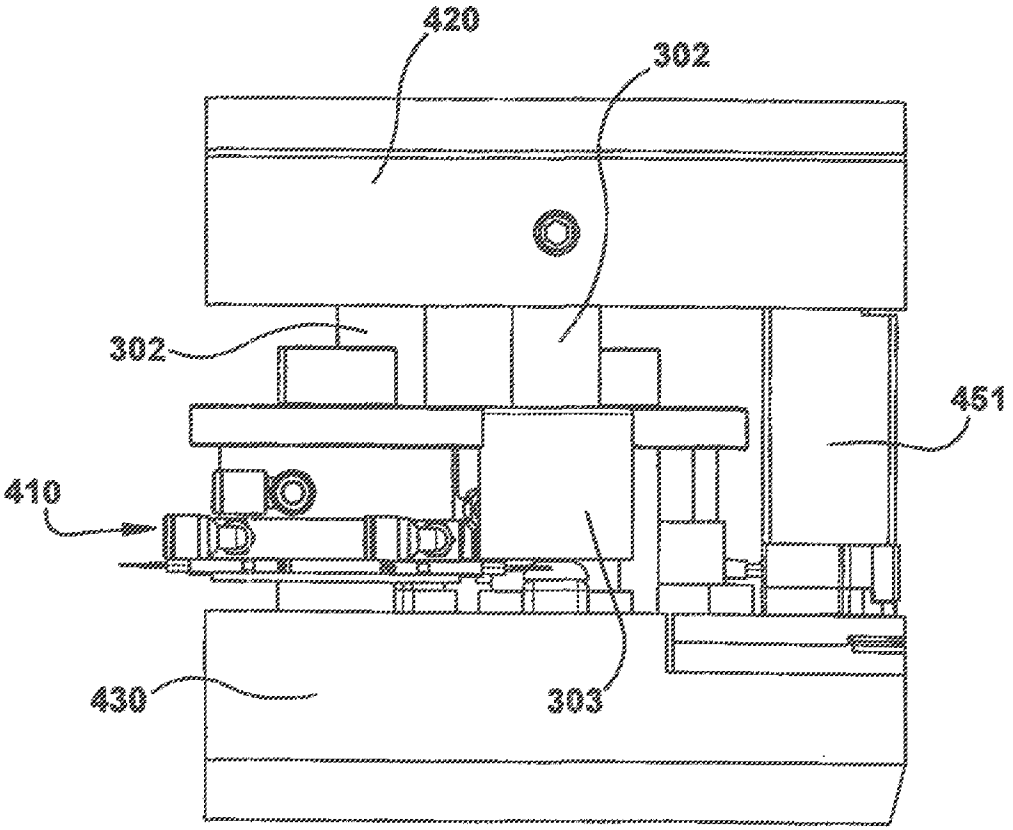

Each ram assembly is securely mounted atop the framework 238 and connected to a fluid supply source 542 (FIG. 22) of high pressure operating air via suitable conduits. Each ram assembly is operated from the controller 120, which outputs a control signal to a suitable or conventional ram controlling valve arrangement when the stock has been positioned appropriately for stamping.

The stamping unit 152 punches the connector holes 82, 84 (FIG. 3) in the stock at the leading and trailing end locations of each frame member 16. When included, a passage 87 is also punched in the stock by the unit 152. In the illustrated embodiment, the die set anvil for punching the holes 82, 84 defines a pair of cylindrical openings disposed on the stock centerline a precise distance apart along the stock path of travel. The corresponding hammer is formed in part by corresponding cylindrical punches, each aligned with a respective anvil opening and dimensioned to just fit within the aligned opening. The stamping unit ram is actuated to drive the punches downwardly through the stock and into their respective receiving openings. The stock is fed into the stamping unit 152 by the downstream driving system and stopped with predetermined stock locations precisely aligned with the stamping unit 152. The punches are actuated by the ram so that the connector holes 82, 84 are punched on the stock midline, or longitudinal axis. When the punches are withdrawn, the stock feed resumes.

Figure 12:
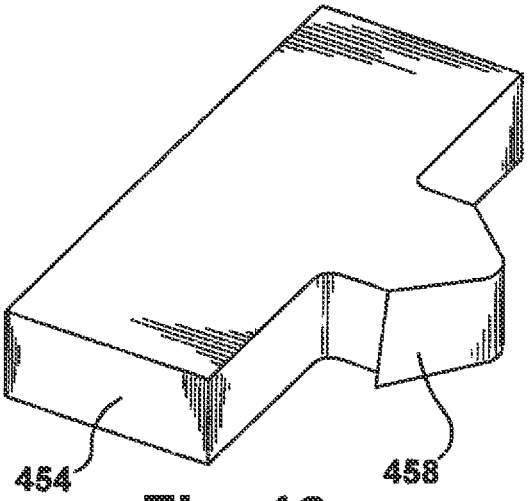

The stamping unit 148 forms the frame corner structures 32*b-d* but not the corner structure 32*a* adjacent the frame tongue 66. The stamping unit 148 includes a die assembly (FIG. 7) operated by a ram assembly. The die assembly 280 punches material from respective stock edges to form the corner notches 50. The die assembly 280 also stamps the stock at the corner locations to define the weakened zones 52, which facilitate the folding of the spacer frame member at the corner locations. The ram assembly preferably comprises a pair of air actuated drive cylinders 290, 292 (FIG. 17) connected to an upper die drive plate 400. Each weakened zone 52 is illustrated as formed by a score line (more than one score line may be included) radiating from corner bend line location on the stock toward the adjacent stock edge formed by the corner notch 50. The score line is formed on the stock strip S by a sharp edged ridge 457 disposed on a scoring tool 458 (FIG. 12, 12A) when contact occurs on the strip S between the scoring tool 458 and a flat surface or flat anvil. A face 459 of the tool 458 that engages the strip stock has a wedge shaped lip or ridge 457 spaced from two triangular elevated lands 461, 463. The elevated shaped lands 461, 463 bias the weakening zones 52 inward along the lateral walls 42, 44 at the notches 50. In the illustrated embodiment, the frame members 16 produced by the production line 100 have common side wall depths even though the frame width varies.

The stamping unit 150 configures the leading and trailing ends 62, 64 of each spacer frame member. The unit 150 comprises a die assembly operated by a ram assembly. The die assembly is configured to punch out the profile of the frame member leading end 62 as well as the profile of the adjoining frame member trailing end 64 with a single stroke. The leading frame end 62 is formed by the tongue 66 and the associated corner structure 32*a*. A trailing frame end 64 associated with the preceding frame member is immediately adjacent the tongue 66 and remains connected to the tongue 66 when the stock passes from the unit 150. The ram assembly comprises a pair of rams each connected to a hammer.

The corner structure 32*a* is generally similar to the corner structures 32*b-d* except the notches 50 associated with the corner 32*a* differ due to their juncture with the tongue 66. The die assembly therefore comprises a score line forming a ridge like the die set forming the remaining frame corners 32*b-d*.

The stamping unit 146 forms muntin bar clip mounting notches in the stock. The muntin bar mounting structures include small rectangular notches. The unit 146 comprises a ram assembly coupled to the notching die assembly. An anvil and hammer of the notching die assembly are configured to punch a pair of small square corner notches on each edge of the stock. Accordingly the ram assembly comprises a single ram which is sufficient to power this stamping operation. A single stroke of the ram actuates the die set to form the opposed notches simultaneously and in alignment with each other along the opposite stock edges.

Each time a new strip passes through the stamping station 104, a scrap piece of stock is formed that is followed by a connected first spacer frame defining length of stock in a given series of multiple spacer frames. In one embodiment, the scrap piece is defined by the punching station 104 whenever a different coil is indexed to the uncoiling station and fed into the punching station 104. The stamping unit 144 configures a leading edge of the scrap piece and trailing end 64 of the last spacer frame member in a series of spacer frame members formed from a particular coil from which the strip unwinds. The trailing edge of the scrap unit is formed by the stamping unit 150 when the leading edge of the first spacer in the next series of spacers formed from this particular sheet stock coil is stamped. The unit 144 comprises a die assembly operated by a ram assembly. The die assembly is configured to punch out the profile of the scrap piece leading end as well as the profile of the end 64 of the last frame member in the series of spacer frame members with a single stroke. The rain assembly comprises a pair of rams each connected to a hammer.

At the end of a series of spacer frame members, the stamping unit 144 forms the trailing end of the last spacer frame member in the series and the leading end of the scrap piece. The stock is then indexed to a stamping unit 154 where the connection between the end of the last spacer frame member and the leading end of the scrap piece is severed. The unit 154 comprises a die assembly operated by a ram assembly. The die assembly punches the material that spans the respective stock edges to sever the stock. The ram assembly preferably comprises a ram connected to the upper die.

A sensor detects the end of the last spacer frame in a series of spacer frame members. Upon detection of the severed end of the last spacer frame, the controller 120 causes the stock feed mechanism 140 to move the rollers 156, 158 to the engaged position. The controller then actuates the motor to cause the drive roller to pull or retract the stock S out of the stamping station 104 and position the stock end at the entrance to the punching station. The stock that forms the last spacer frame member in the series is driven out of the machine by the downstream stock driving mechanism. The controller then moves the stock feed mechanism 140 to the disengaged position to release the stock end. The stock end remains secured by a clamping mechanism (not shown). The controller 120 may then index the next selected coil to the uncoiling position and place the end of this next selected strip between the rollers 156, 158. The controller 120 then controls the stock feed mechanism to start the next series of spacer frame units.

In order to accommodate wider or narrower stock passing through the station 104, the die assembly is split into two parts. In one embodiment, one side of each die assembly is fixed and the opposite side of each split die assembly is adjustably movable toward and away from the corresponding fixed die assembly to allow different width spacer frames to be punched. Also, each anvil is split into two parts and each hammer is likewise split.

Figure 8:
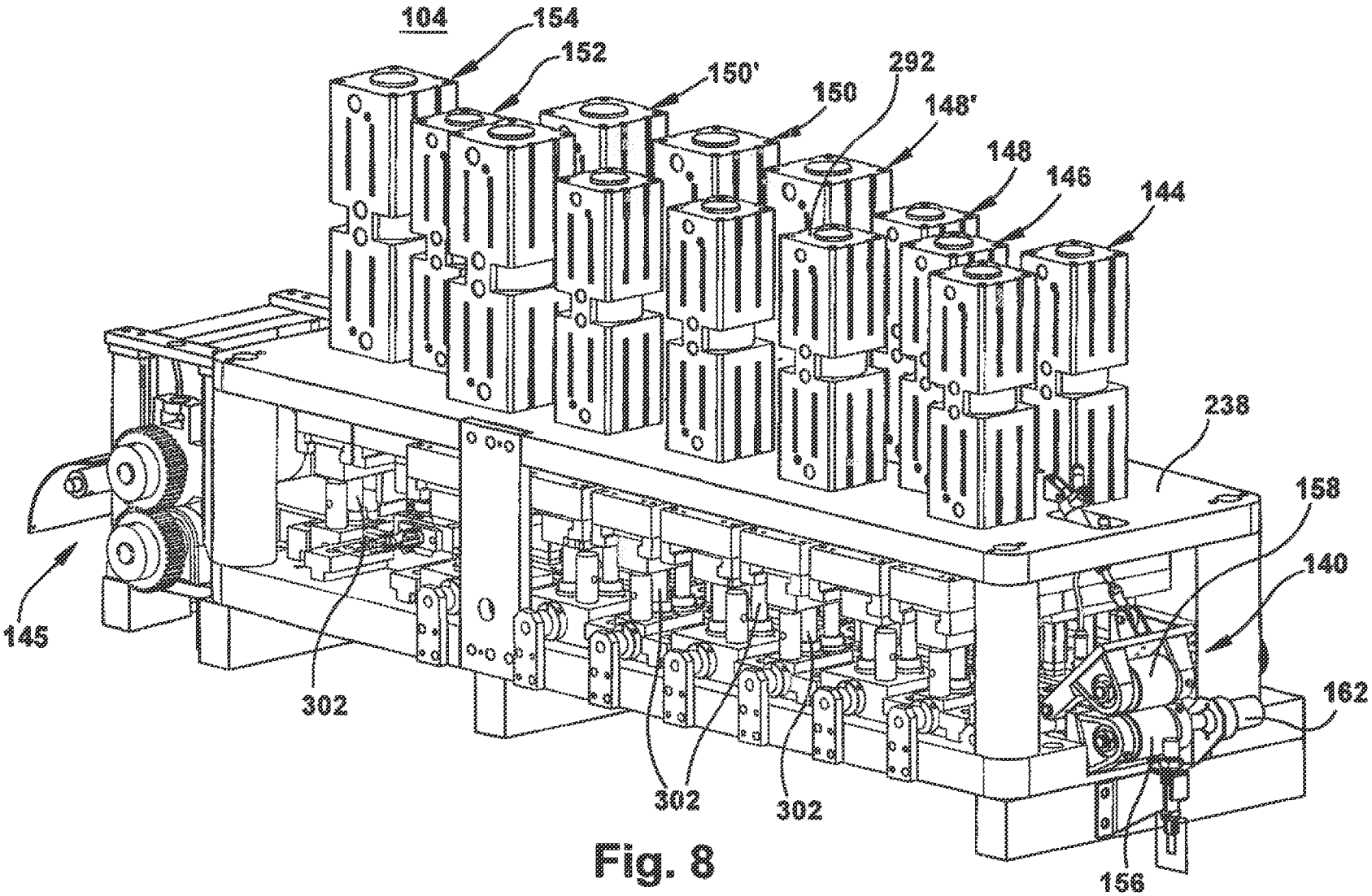
FIG. 8 is a perspective view of a punching station.
Figure 15:
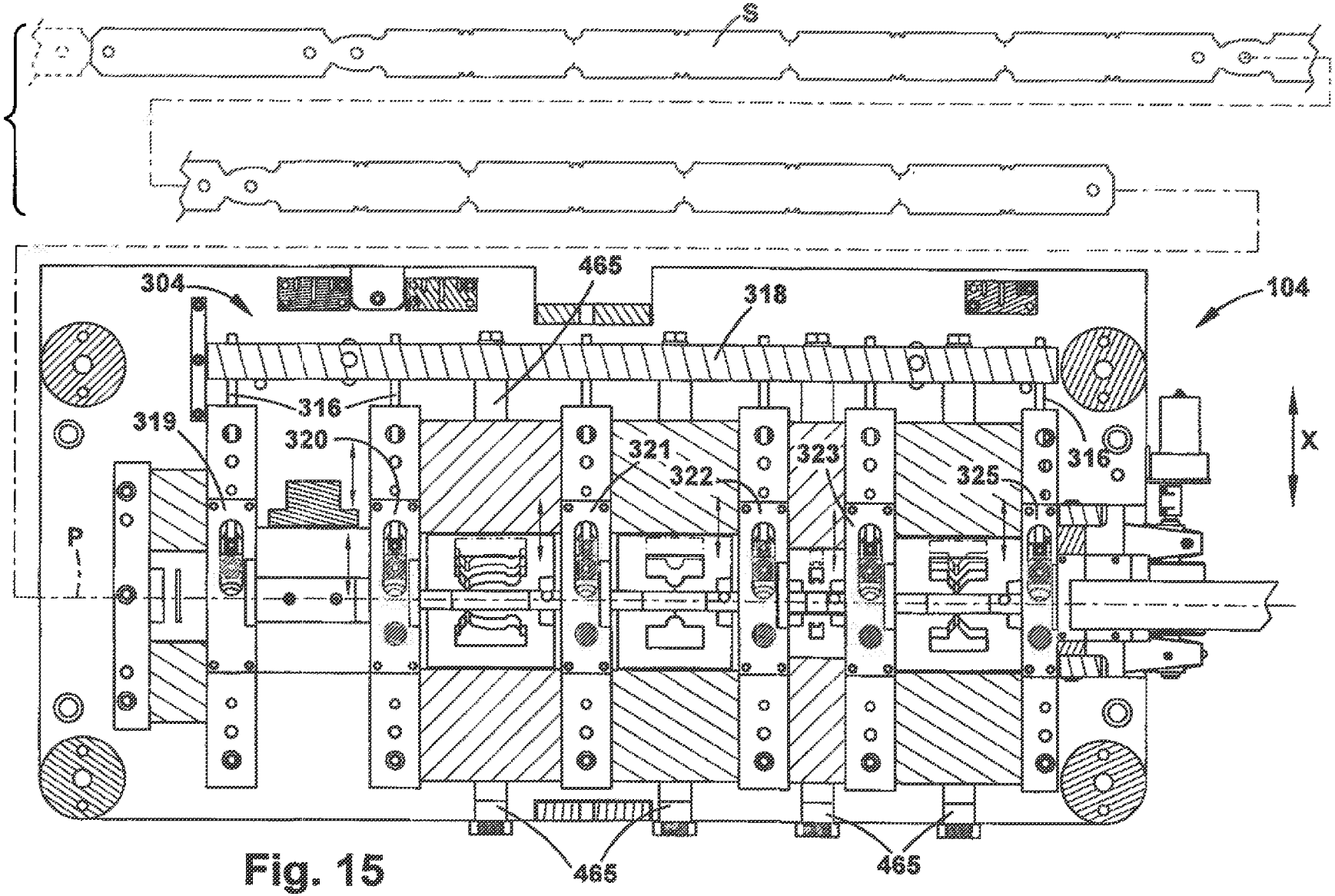
FIG. 15 is a section view of a punch station having a capability for moving a set of dies back and forth to accommodate different width stock.

FIGS. 8 and 15 illustrate an example embodiment having a fixed side array of dies wherein an opposite side of the strip S path of travel includes moveable die sets. The moveable opposed hammer and anvil parts are linked by vertically extending guide rods 302. The guide rods 302 are fixed in the hammer parts and slidably extend through bushings in the opposed anvil parts. The guide rods 302 both guide the hammers into engagement with their respective anvils and link the hammers and respective anvils so that all the hammers and anvils are adjusted laterally together.

Referring to FIG. 15, the moveable hammer and anvil parts of each die assembly that make up the punching station 104 are movable horizontally towards and away (see Arrows X in FIG. 15) from the fixed hammer and anvil parts by an actuating system 304 to desired adjusted positions for working on stock of different widths. The actuating system 304 firmly fixes the die assembly parts at their horizontally adjusted locations for further frame production. The anvil parts of each die assembly are respectively supported in ways or guides attached to driving members 319, 320, 321, 322, 323, 325 attached to a stamping unit frame 238. The hammer parts of each die assembly are also each supported in ways or guides, which are coupled to a respective die actuator, or ram. The guides extend transversely to the travel path P of the stock strip S and the actuating system 304 shifts the hammer parts and the anvil parts simultaneously along the respective ways between adjusted positions.

The illustrated actuating system is controlled by the controller 120 to automatically adjust the punching station 104 for the stock width provided at the entrance of the station. The width of the stock provided to the station 104 may be detected and the controller automatically adjusts the station 104 to accommodate the detected width. The illustrated actuating system 304 provides positive and accurate moveable die assembly section placement relative to the stock path of travel. The system 304 comprises a plurality of drivescrews 316, a drive transmission 318 coupled to the drivescrews, and die assembly driving members 319, 320, 321, 322, 323, 325 driven by the drivescrews 316 and rigidly linking the drivescrews to the anvil parts. The drive transmission 318 is attached to a die spacer 465 (described below) which rigidly attaches to an anvil support.

The drivescrews 316 are disposed on parallel axes and mounted in bearing assemblies connected to lateral side frame members. Each drivescrew is threaded into its respective die assembly driving member 319, 320, 321, 322, 323, 325. Thus when the drivescrews rotate in one direction the driving members 319, 320, 321, 322, 323, 325 force their associated die sections (hammer and anvil) to shift horizontally away from the fixed die sections. Drivescrew rotation in the other direction shifts the die sections toward the fixed die sections. The threads on the drivescrews 316 are precisely cut so that the extent of lateral die section movement is precisely related to the angular displacement of the drivescrews creating the movement.

The hammer sections of the die assemblies are adjustably moved by the anvil sections. The guide rods 302 extending between confronting anvil and hammer die sections are structurally strong and stiff and serve to shift the hammer sections of the die assemblies horizontally with the anvil sections. The hammer sections are relatively easily moved along the upper platen guides or ways.

Figure 21:
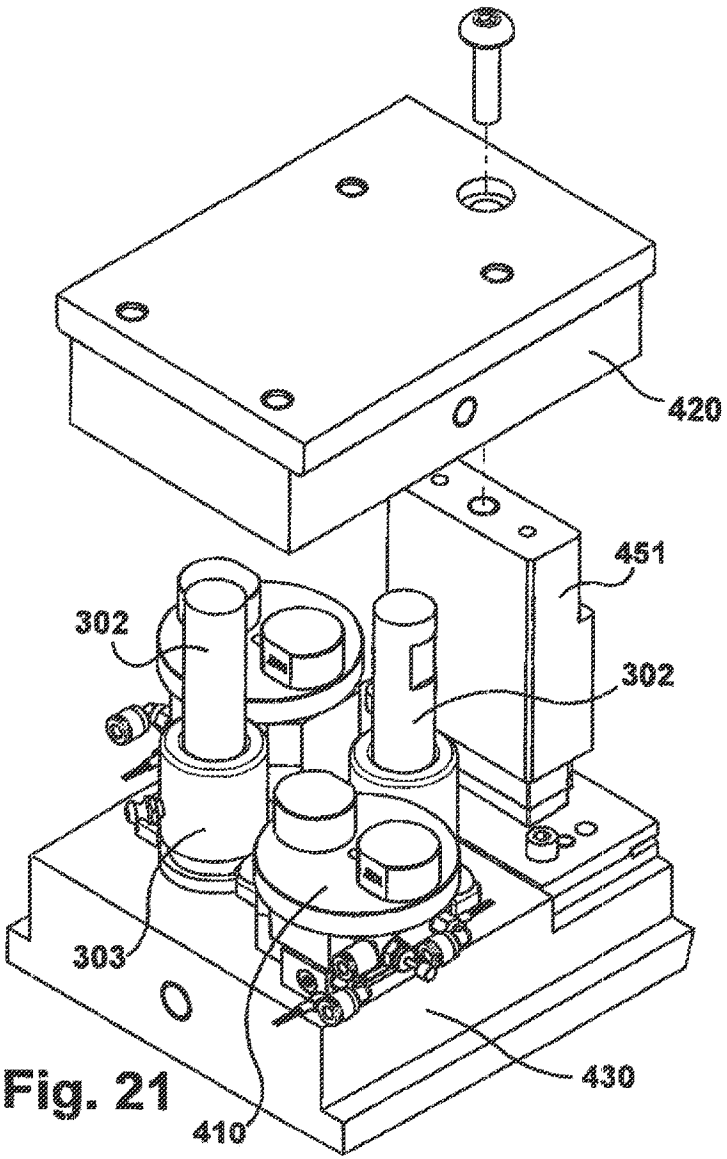
FIGS. 20 and 21 are perspective views of a die support and an anvil support depicting placement of stop assemblies for controlling movement of the die support.
Figure 20:
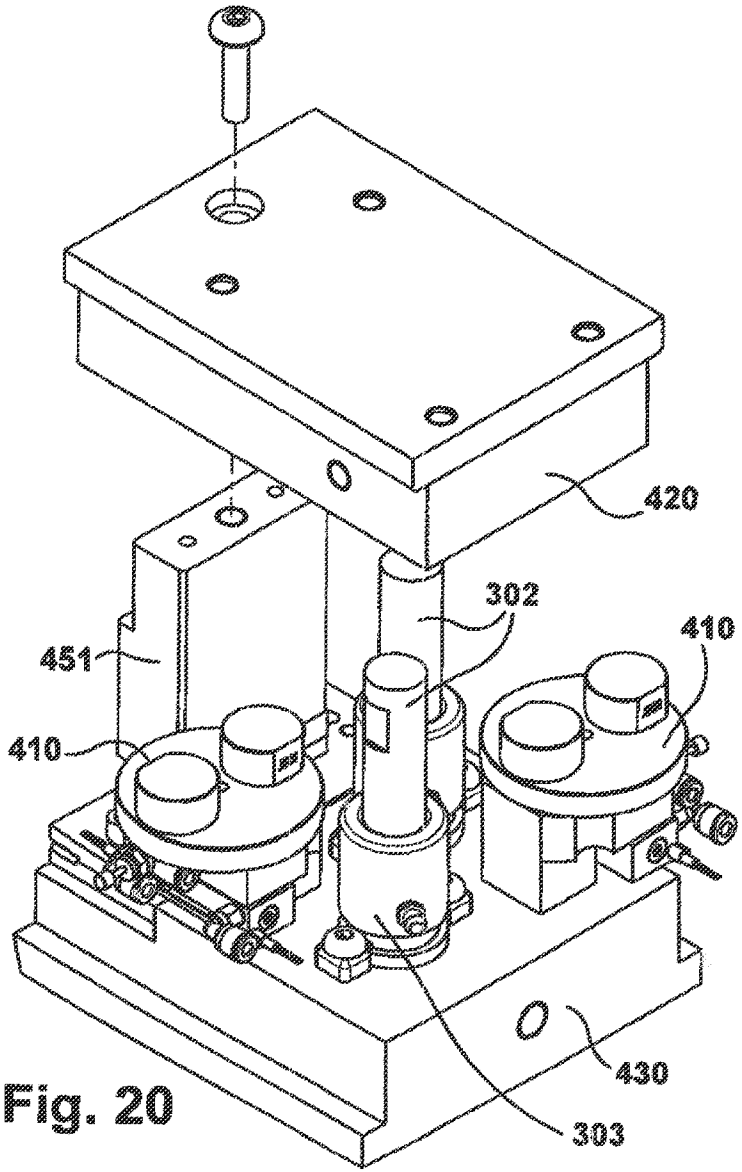
Figure 23:
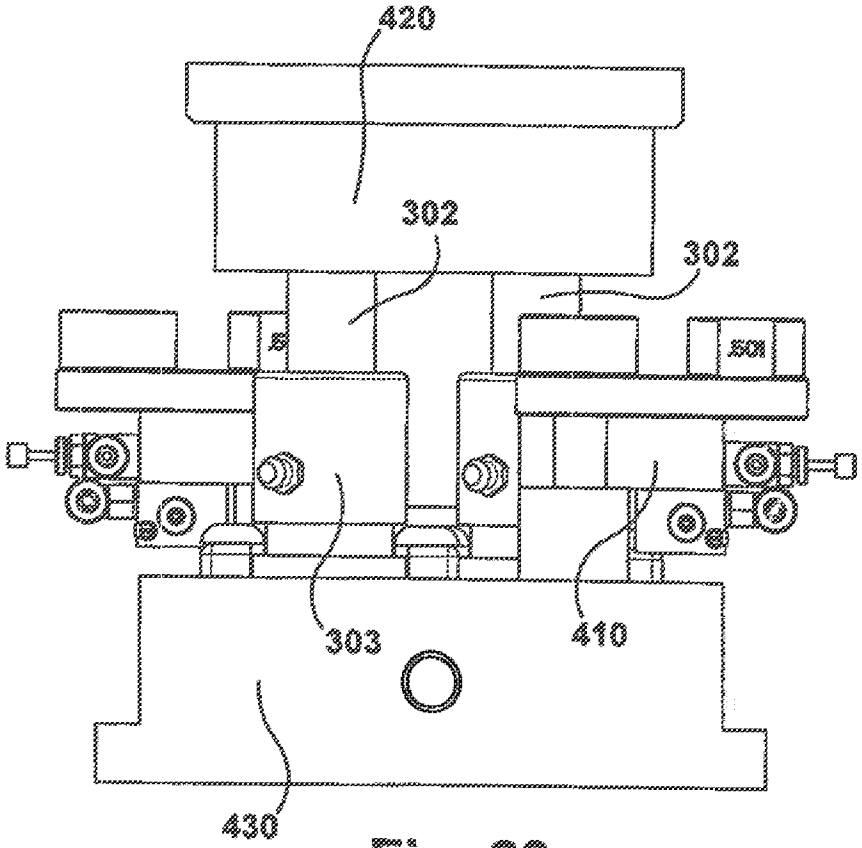
FIGS. 22, 23, and 24 are front, side and rear elevation views of a die support and an anvil support depicting placement of stop assemblies for controlling movement of the die support during stamping of a corner location on a strip.

Once the strip S leaves the punching station 104, it enters a roll forming station 106 wherein a series of rolls contact the strip and bend it into a U-shaped channel or form 312 shown in FIG. 21. Roll formers for accepting elongated strip and converning them into channel shaped elongated metal U shaped channels are know in the art and one example of such a roll former is commercially available from GED Integrated Solutions Inc., assignee of the present disclosure.

Controlled Corner Formation

As mentioned previously the ram assembly that forms part of the stamping unit 148 preferably comprises a pair of rams supported by the framework most preferably implemented using two air actuated drive cylinders 290, 292 (FIG. 17) commercially available from Festo Corp, under the designation or model number 13049375 or 13005438. An upper die assembly includes a drive plate 400 for at least two dies which move up and down (+/−⅜") along the y axis seen in the elevation view of FIG. 7. Downward movement of the drive plate 400 attached to the two dies is limited by one or more ram limiting stop assemblies 410 having a contact region or surface whose position with respect to a die support is adjusted depending on the material of the strip S passing through the station 104.

Figure 7:
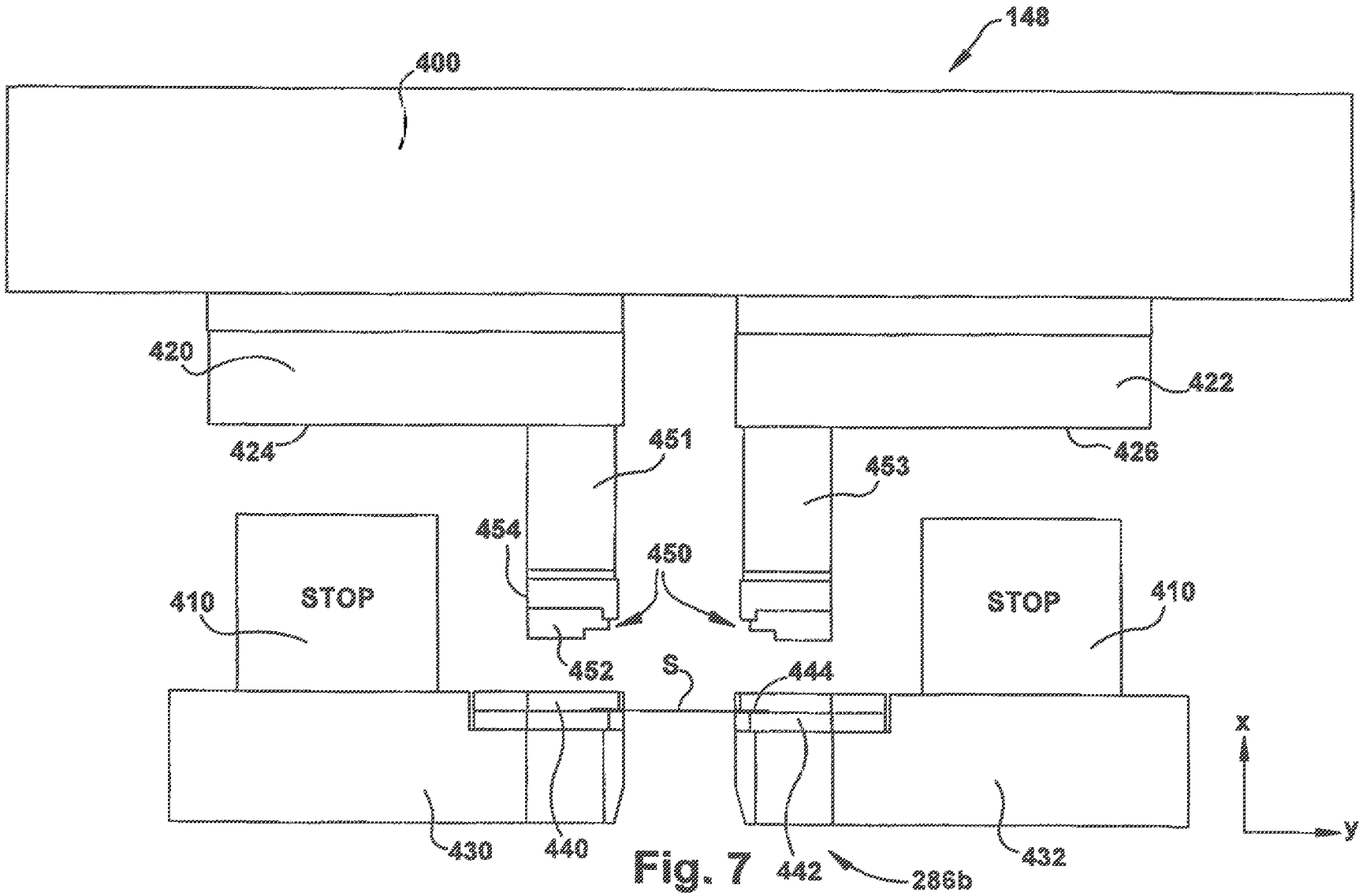
FIG. 7 is an elevation view of a corner stamping unit that forms part of a punch station.
Figure 9:
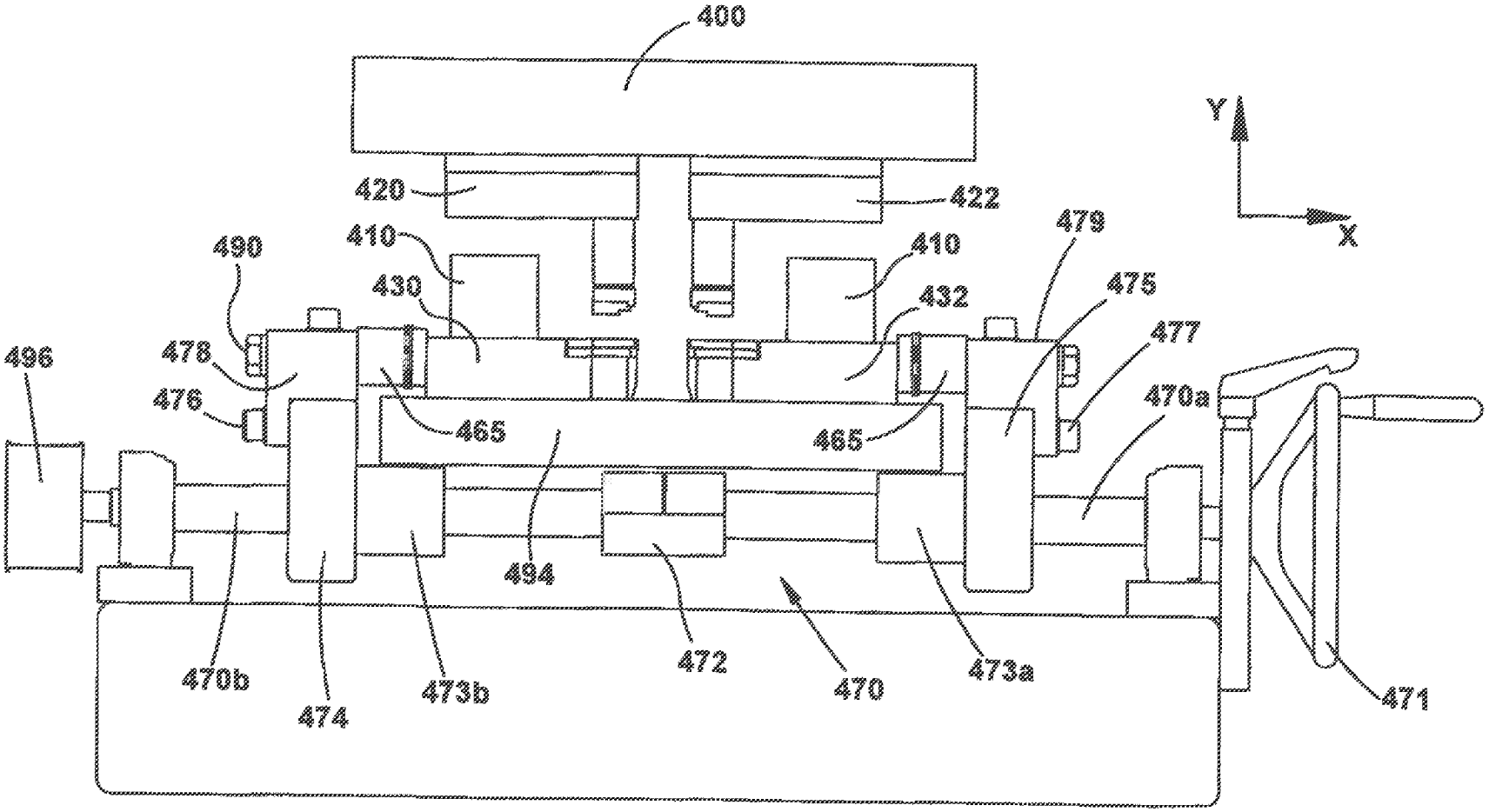
FIG. 9 is side elevation view of a corner stamping unit having spacer elements that position a strip in relation to a die as the strip moves into position for stamping.
Figure 10:
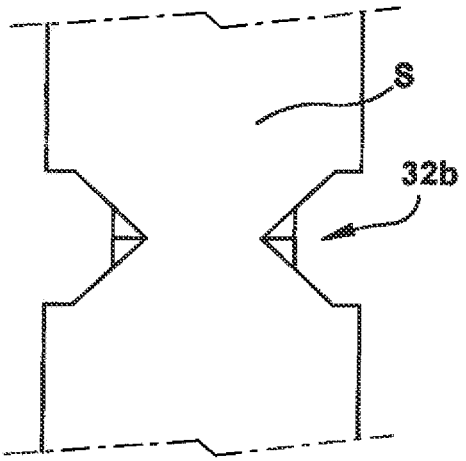
FIG. 10 is a plan view of a portion of an elongated metal strip for use in forming a spacer frame.

In an exemplary embodiment, the stamping unit has a first moveable die support 420 that supports one die for deforming one side of the strip S and a second moveable die support 422 that supports a second die for deforming an opposite side of the strip. These two die supports are coupled to the drive plate 400 for up and down movement with the drive plate in response to controlled actuation of the two air actuated drives 290, 292. In the embodiment of FIGS. 7 and 9, both dies can be shifted (+/− approximately ¾ inch in the X direction, see FIG. 7) to the side to accommodate different width strips S. When the two air actuated drive cylinders extend their pistons, the plate 400 is driven downward (−y) along with the attached die supports 420, 422 to bring the first and second dies into engagement with the strip. Bottom surfaces 424, 426 of the die supports 420, 422 engage the contact surfaces of the stop assemblies 410 as a means of limiting movement of the dies and hence controlling the deformation of the strip S by those dies.

Figure 12A:
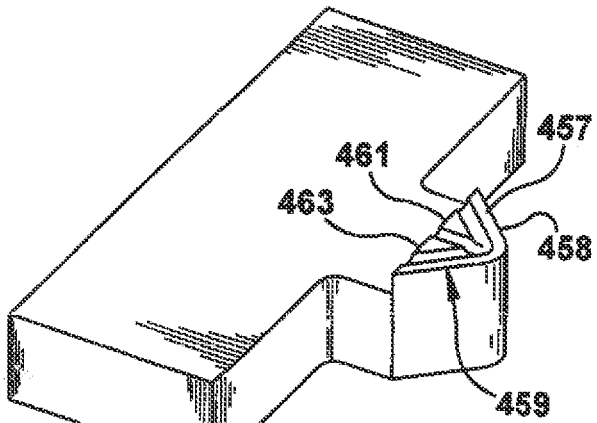

The stamping unit 148 has first and second moveable anvil supports 430, 432 each supporting a stripping element 440 that the die passes through to come in contact with the strip S and a die contact or backing element 442. A region between the stripping element and the die contact element 442 defines a slot 444 which accomodates movement of the strip S through the punching station 104. Guide rollers (not shown) route the strip stock S (along the z direction as defined in FIG. 7) into the region of the die with great accuracy (within 5 thousands of an inch) so that the strip just passes through the slot 440 without binding. The die contact element 442 has a flat upwardly facing surface 442*a* which the die and particular the die ridge 459 (FIG. 12A) engages to deform the metal strip S when the metal strip is impacted by downward movement of the die.

A representative die 450 is removably connect to respective die supports 451, 453 and is depicted in FIGS. 11, 11A, 12, and 12A. The die 450 includes a notching portion 452 for removing metal from the strip S and a deforming portion 454 for deforming a portion of the metal of the strip near the removed metal to facilitate formation of a corner.

In the illustrated example embodiment of FIG. 7, there are stop assemblies 410 on opposite sides of the strip S path of travel having upper facing, generally planar adjustable stop surfaces (described in detail below) which are contacted by the bottom surfaces 424, 426 of the die supports 420, 422 for limiting transfer of energy from the dies to the strip and thereby control deformation of the strip.

Die/Anvil Positioning

As mentioned above, the first and second anvil supports 430, 432 are coupled to their respective die supports 420, 422 by connecting guides 302. This arrangement is further depicted in FIG. 21 and FIGS. 23-29. The connecting guide 302 is securely attached to an associated die support 420 and extends through bushings 303 supported by the anvil support. This construction allows up and down movement of the die supports with respect to their associated anvil supports. These guides support and define the movement of the ram assembly with respect to the strip stock and are located in prescribed positions reducing friction and misalignment. Additionally as the anvil support is being translated back and forth to accept different width strip stock the guide 302 transmits a force to move the die support 420 relative the drive plate 400 in unison with the anvil support.

Unlike the example embodiment of FIG. 15, wherein only one set of anvil and dies are moved by the control 120, the embodiment shown in FIG. 15 is adjusted by manual rotation of a drive screw 470 that is rotated by a hand crank 471 in one sense or the other to either widen or narrow the gap between the dies and respective anvils. The exemplary drive screw 470 is an acme screw having two halves 470*a*, 470*b* of different thread direction connected together by a coupling 472. Each half of the drive screw engages a corresponding drive nut so that for example the drive screw half 470*a* engages a drive nut 473*a* and the drive screw half 470*b* engages a drive nut 473*b*. In another embodiment not shown, the hand crank is replaced by a motor.

Two movable mounts 474, 475 are attached to the drive nuts 473*a*, 473*b* so that as rotation of the screw halves moves the drive nuts, the mounts 474, 475 move as well. Due to the reverse threads used in the screw halves, the mounts 474, 475 move in opposite directions along the x axis as that axis is defined in FIG. 15. As the mount 474 moves in the positive x direction for example, the mount 475 moves in the negative x direction.

Threaded connectors 476, 477 attach removable stops 478, 479 to the mounts 474, 475 so that the stops move back and forth with the mounts as the screw halves are rotated. As seen also in FIG. 9, an adjustable spacer 465 is trapped or wedged between the removable stops 478, 479 and the anvil supports 430, 432. These spacers 465 have two surfaces 480, 481 (FIG. 26) trapped between generally planar surface of a removable stop and an anvil support.

As seen in FIG. 9, a first pair of die and anvil assemblies are moveably supported by an elongated support 494 which extends to an opposite side of the strip stock path of travel where a second pair of die and anvil assemblies are moveably coupled to said elongated support. FIG. 21 illustrations stationary guides or ways 309, 311, 313, 315 that guide the die support 420 and the anvil support 430 for back and forth movement in response to user adjustment of the crank. As seen in the figure, the anvil support 430 has two elongated flanges 431, 433 that extend into the ways 309, 315 and slide back and forth in those ways.

Stop Assembly 410

Exemplary stop assemblies 410 (FIG. 27) have two generally cylindrical stops 810, 812 made of hardened tool steel attached to a rotatable stop body 814. The two stops have different thickness dimensions (as indicated in the y direction of FIG. 27) and are supported by the stop body 814 for rotation about an axis of rotation 816 so that one or the other (but not both) of the stops 810, 812 is positioned for contacting the bottom surface 424 of the die support 420 as the die support is driven by the punch. Details of the construction of the stops are depicted in the exploded perspective of FIG. 28. An exemplary removable portion 820 of the stop 810 is made of hardened tool steel and a centrally located recess 822 fits over an upwardly extending stud 824 of the rotatable stop body 814. A removable portion 821 of the stop 812 is similarly positioned on a stud 825. Four cylindrical magnets 830 attract the removable stop portion 820 and fit into recesses 832 of the rotatable stop body 814 and have top surfaces flush with a top surface 834 of the rotatable stop body 814.

Figure 30:
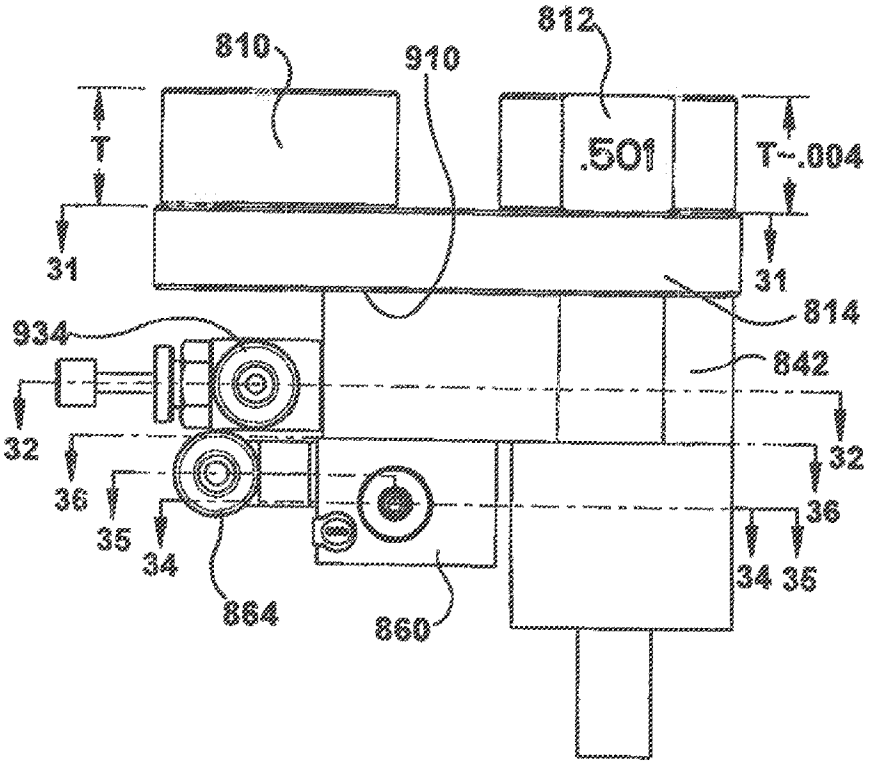
FIGS. 29 and 30 are front and side views of the stop assembly of FIG. 27.
Figure 29:
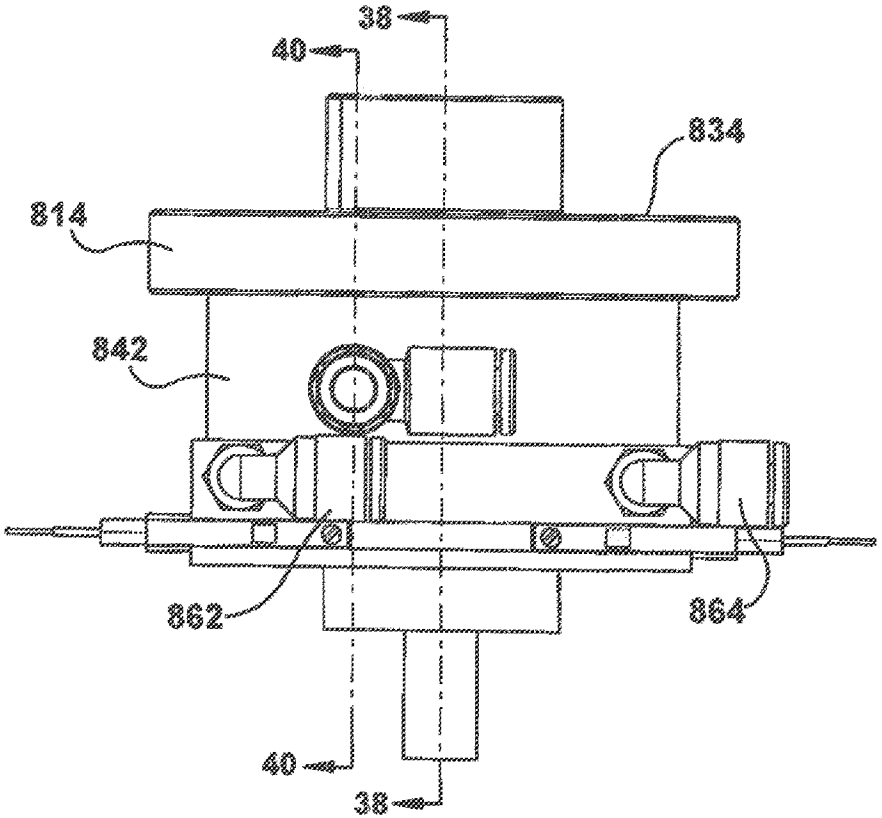
Figure 31:
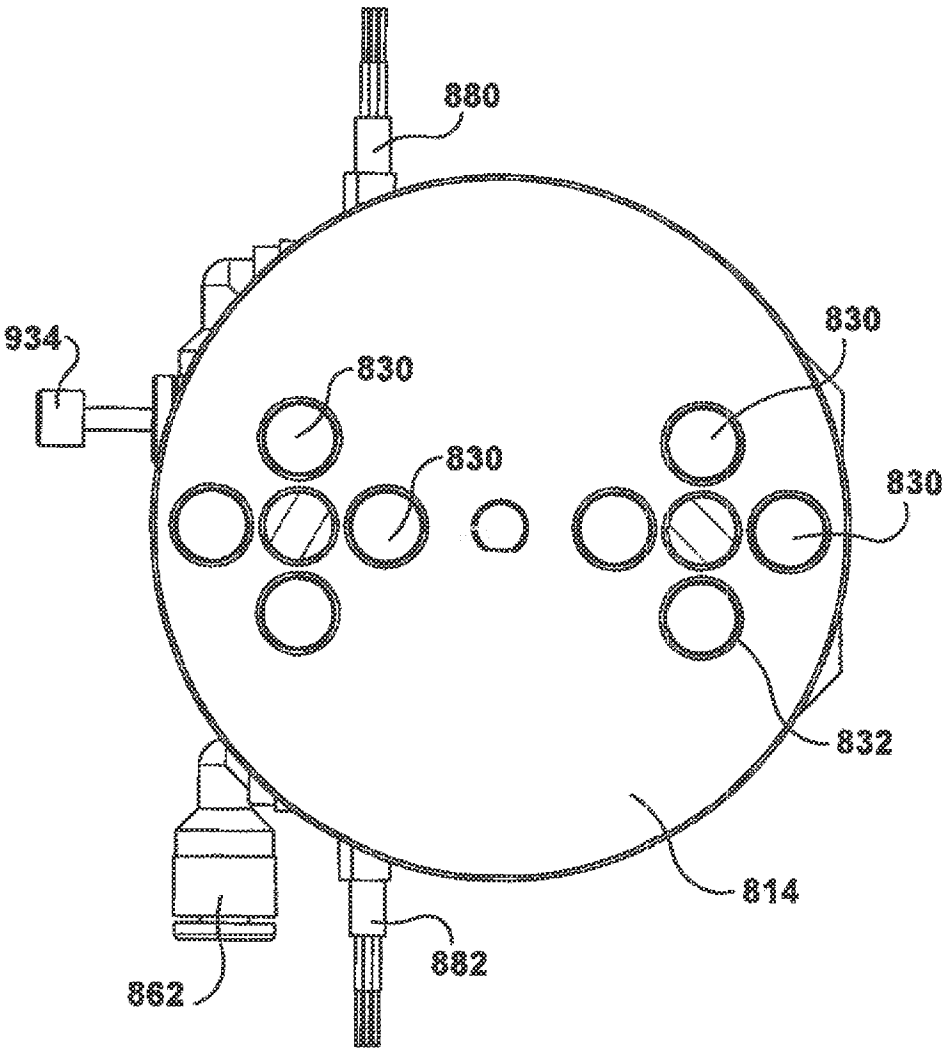
FIG. 31 is a view as seen from the plane defined by the line 31-31 in FIG. 30.
Figure 33:
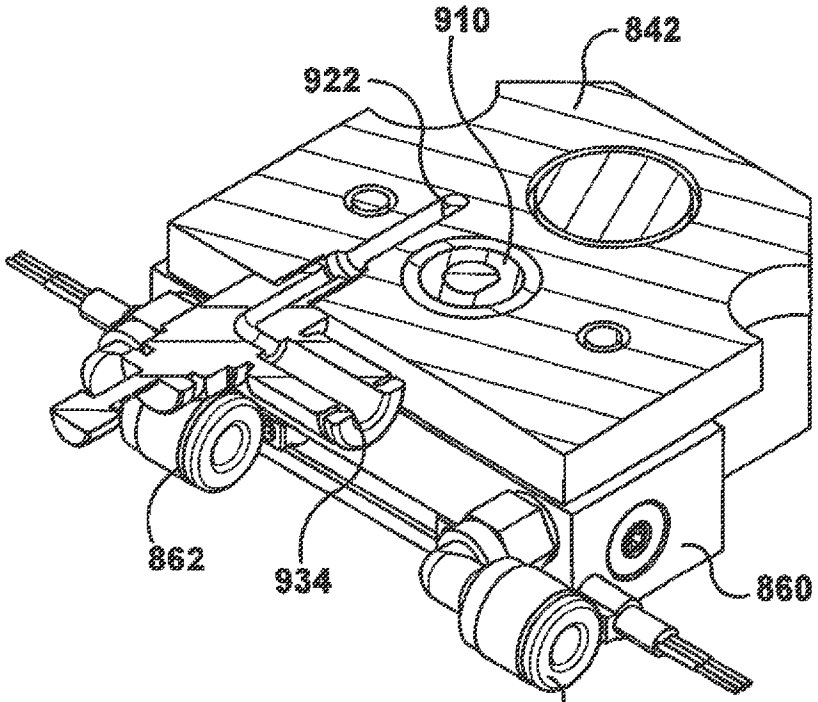
FIG. 33 is a perspective view showing a passageway for routing fluid through a stop assembly support.

In the exemplary embodiment, the thickness or height of the two stops 810, 812 are different and more specifically varies over a range to adjust downward movement of the die by as much as 0.010 inch. (ten thousandths of an inch) By way of example Tin plated steel, for a stainless strip S a thickness of the removable portion 820 provides adequate deformation with a thickness T (FIG. 30). For stainless steel strip of the same thickness, a removable portion has a thickness T−0.004 inch to increase the energy transmitted compared to Tin plated steel strip. As explained below, the control 120 automatically rotates an appropriate one of the two stops 810, 812 into a die support contacting position, depending on what strip material is passing through the punch station. In the exemplary embodiment two stops are supported by each of the stop assemblies 410 but more than two stops could be used on the rotatable stop body 814, so long as only one at a time of the stops is positioned for contact with the die support.

Controlled rotation of the rotatable stop body 814 is performed by controlled application of fluid from a fluid source 542 (FIG. 16) to a stop actuator 840 that is attached to a stop body 842 fixedly attached to and supported by the anvil support 430. A representative stop acutator 840 is commercially available from SMC under part number CRJB05-180 and is depicted in greater detail in the perspective view of FIG. 19. Additional details regarding operation and performance of the actuator are available in the specification sheet for the actuator, which is incorporated herein by reference in its entirety.

Figure 19:
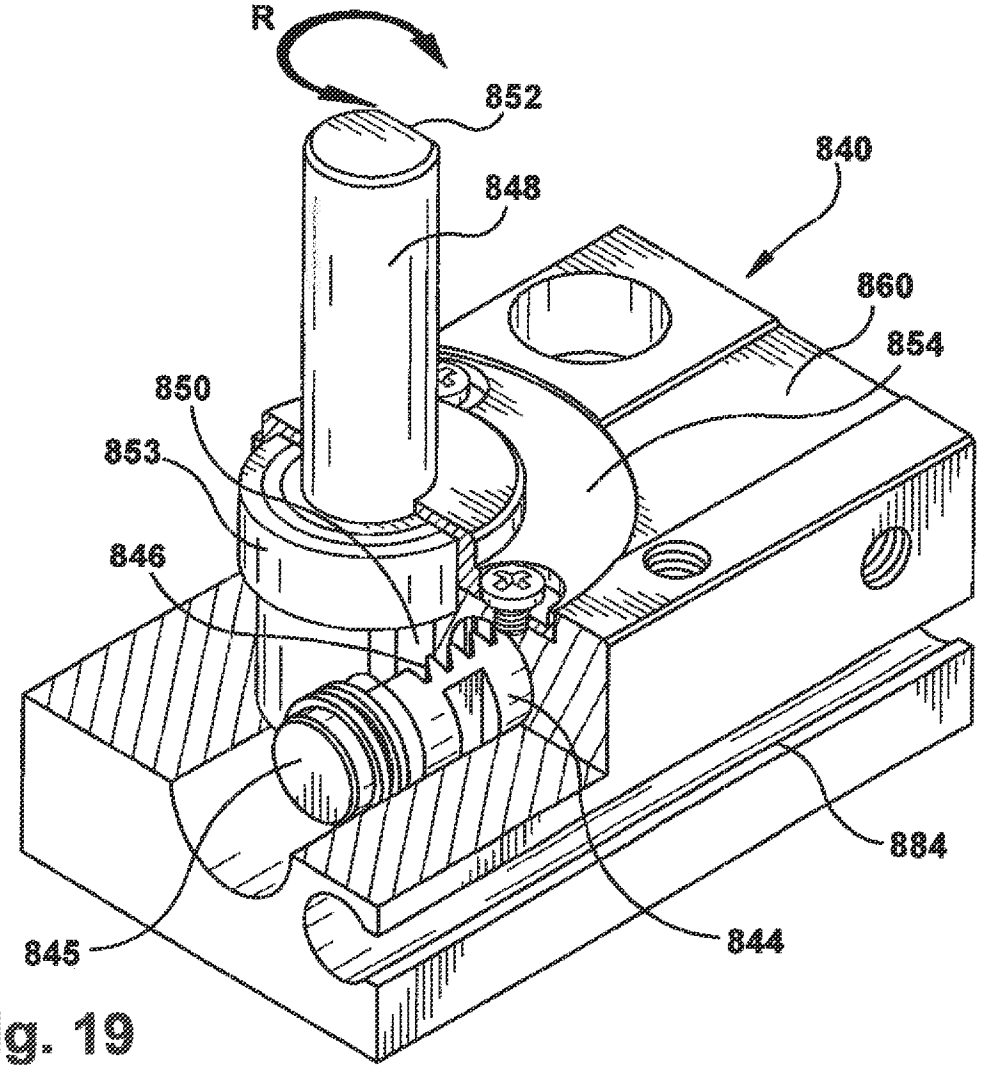
FIG. 19 is a perspective view of a stop actuator.

As seen in FIG. 19, the actuator 840 includes a drive piston 844 having first and second ends 845 (only one of which is visible in FIG. 19) that supports a rack gear 846 that extends along a length of the drive piston 844. An actuator output shaft 848 has a pinion gear 850 at one end that engages the rack gear 846 of the piston and a flat 852 at an opposite end. The shaft 848 extends through a bearing 853 supported by an actuator body 860 and fits into an internal opening of the rotatable stop body 814 having a internal flat (not shown) which engages the flat 850 on the shaft. A cover 854 attached to the body 860 covers the bearing 853. Rotation of the output shaft 848 due to back and forth movement of the piston 844 causes the shaft 844 to impart back and forth rotational movement to the rotatable stop body 814. In the exemplary embodiment, the shaft rotates a total of 180 degrees from one extreme of piston travel to its other extreme of travel, as indicated by arrows R in FIG. 19.

Figure 27:
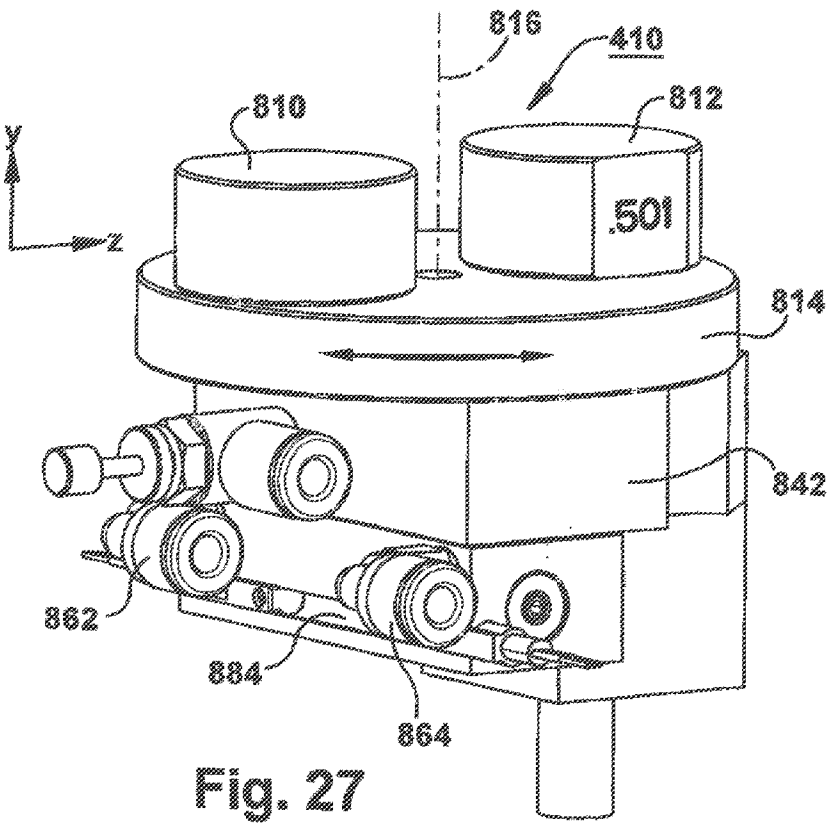
FIG. 27 is a perspective view of a stop assembly.

The piston 844 is supported in the actuator body 860 having pressure conveying passageways for conveying air under pressure through the passageways to opposed ends 845 of piston 844 for imparting back and forth movement to the piston which in turn is converted to back and forth rotation of the output shaft 848 of the stop actuator 840. As seen in FIG. 27, quick disconnect couplings 862, 864 are coupled to threaded openings on the actuator body 860. When pressurized fluid (most preferably air) is transmitted from the source 542 through a valve 870 to a conduit 872 (FIG. 41) coupled to the coupling 862 the piston 844 moves in one sense and the rotatable body 814 rotates in a counterclockwise sense as seen in FIG. 19. When pressurized fluid (most preferably air) is transmitted from the source 542 through the valve 870 to a conduit 874 (FIG. 41) coupled to the coupling 864, the piston 844 moves in an opposite sense and the rotatable body rotates in a clockwise sense as seen in FIG. 19.

In the preferred embodiment, the control 120 monitors operation of each of the actuators (in the preferred embodiment there are four such actuators, two on each side of the strip). Sensors 880, 882 supported by the body 860 are placed into a slot 884 of the body so that an end of piston travel indicator is sent to the controller which in turn allows the controller to reverse the air flow direction to the other end of the piston that was pressured to rotate the rotatable stop body. The sensors 880, 880 are commercially available from SMC, part number D-M9P-SAPC.

Figure 32:
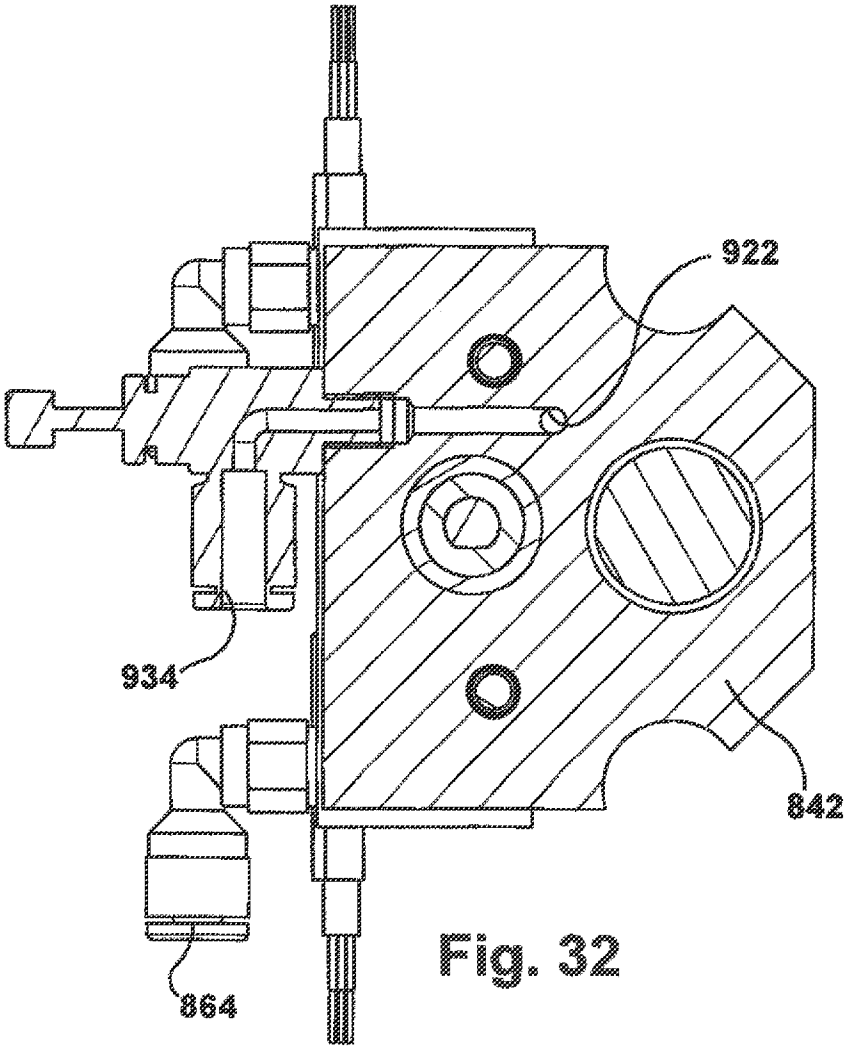
FIG. 32 is a view as seen from the plane defined by the line 32-32 in FIG. 30.
Figure 35:
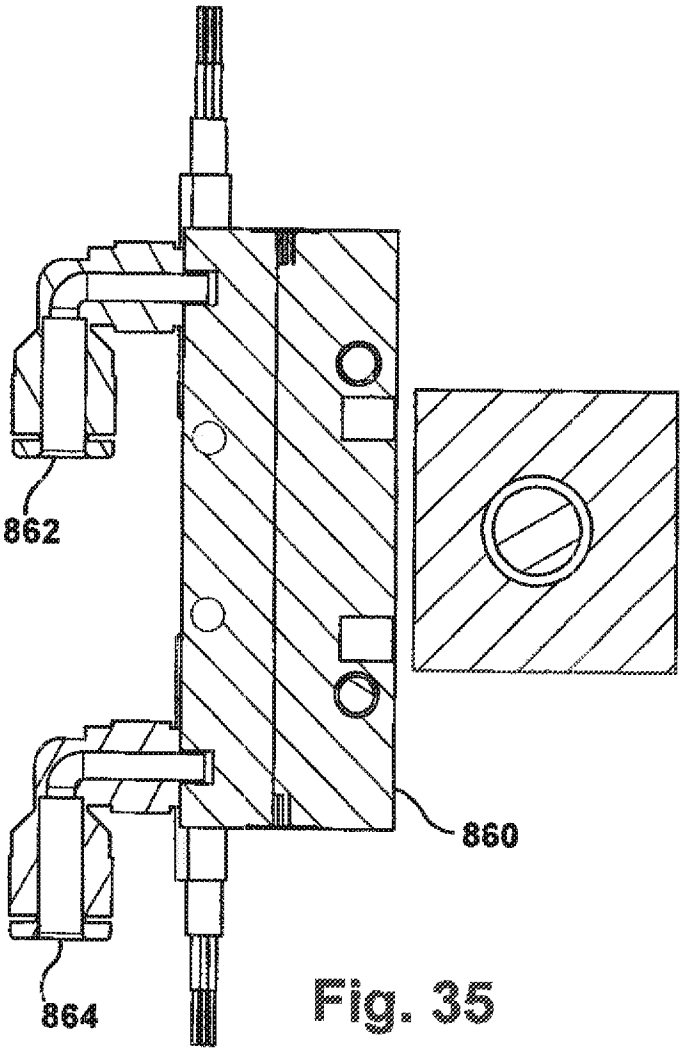
FIG. 35 is a view as seen from the plane defined by the line 35-35 in FIG. 30.
Figure 34:
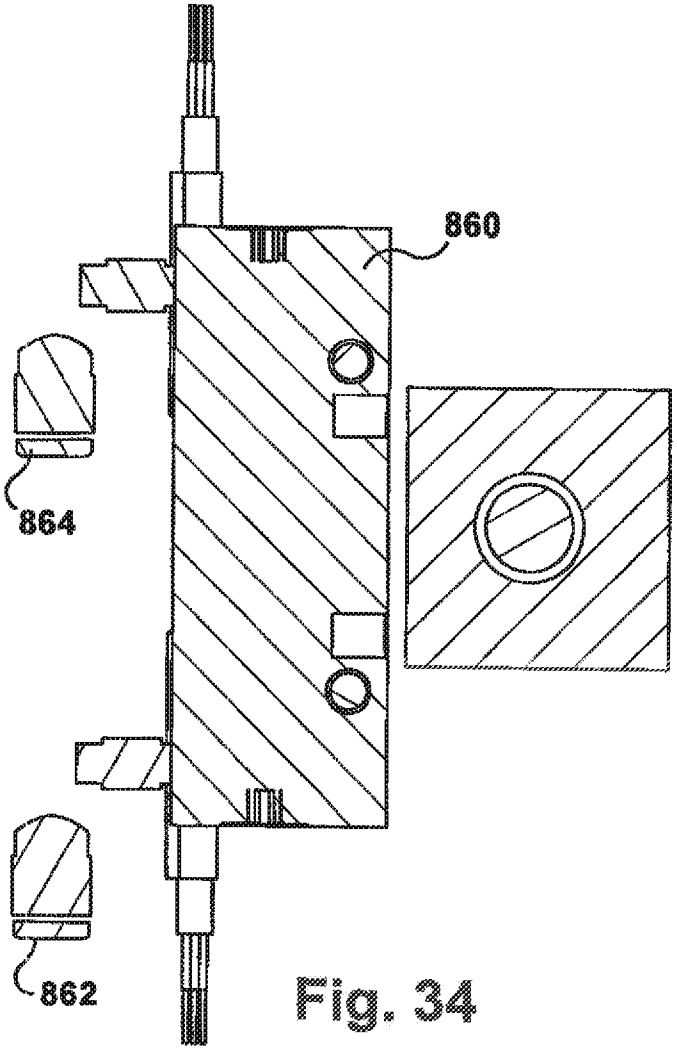
FIG. 34 is a view as seen from the plane defined by the line 34-34 in FIG. 30.
Figure 37:
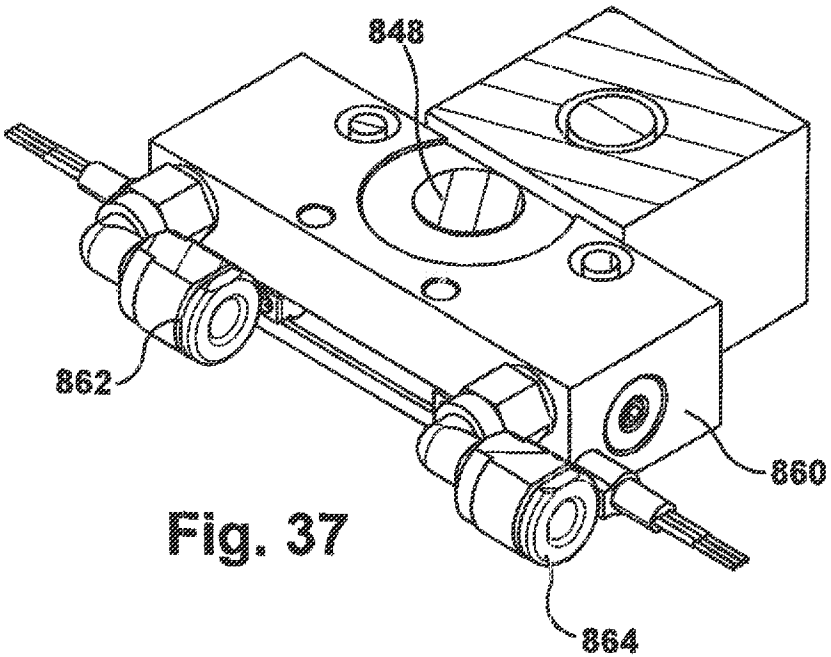
FIG. 37 is a perspective view of a stop actuator.
Figure 36:
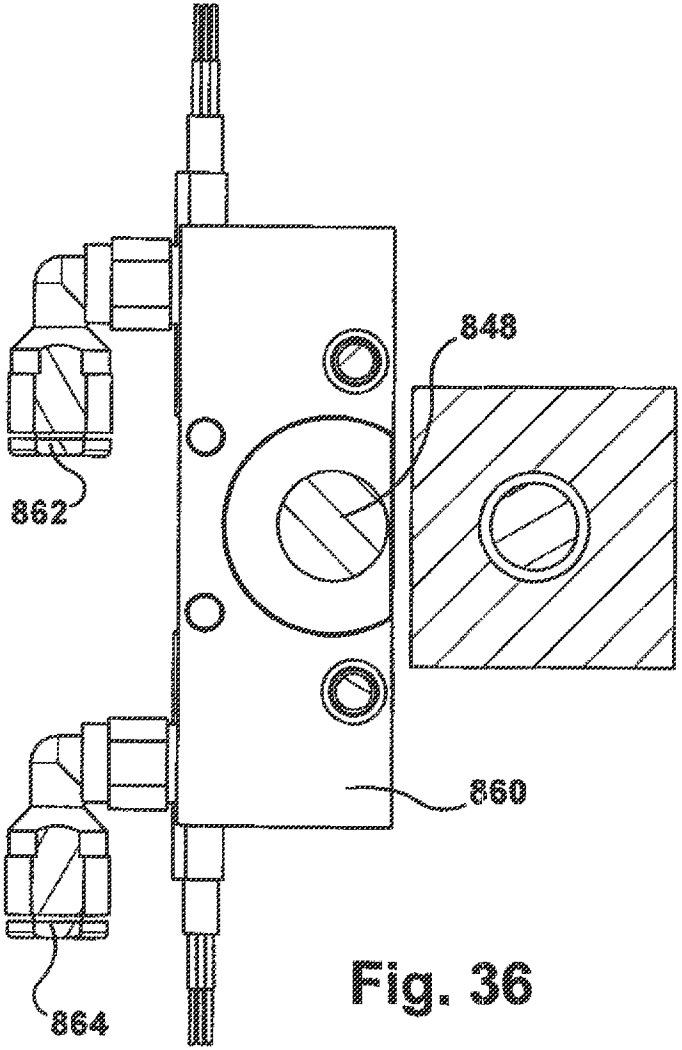
FIG. 36 is a view as seen from the plane defined by the line 36-36 in FIG. 30.
Figure 39:
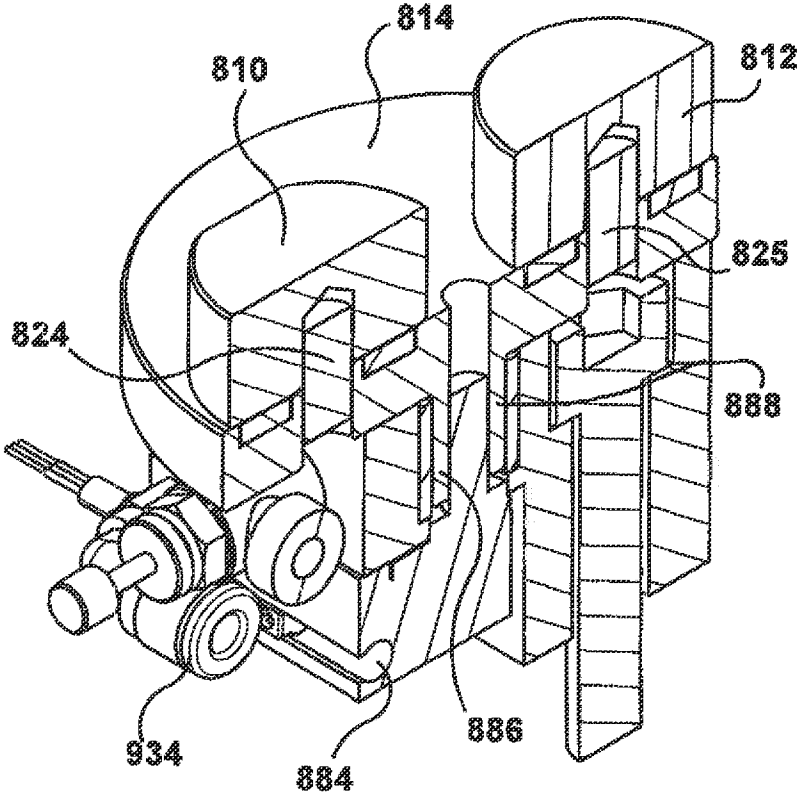
FIG. 39 is a section perspective of a stop assembly.
Figure 38:
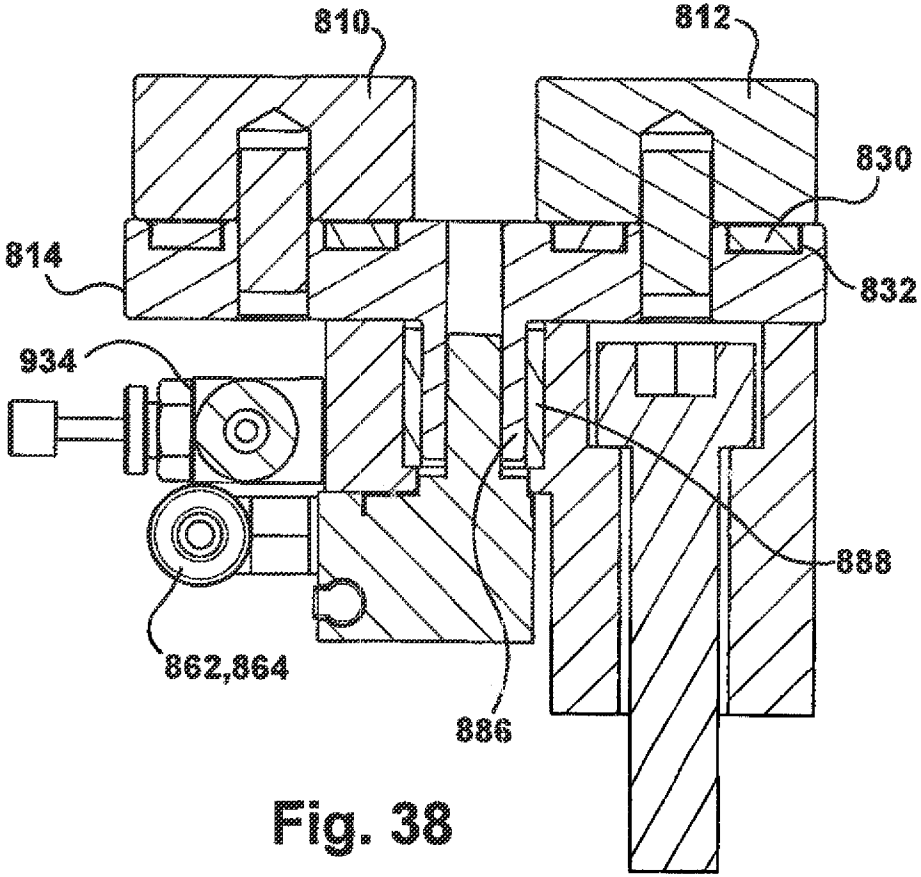
FIG. 38 is a view as seen from the plane defined by the line 38-38 in FIG. 30.
Figure 40:
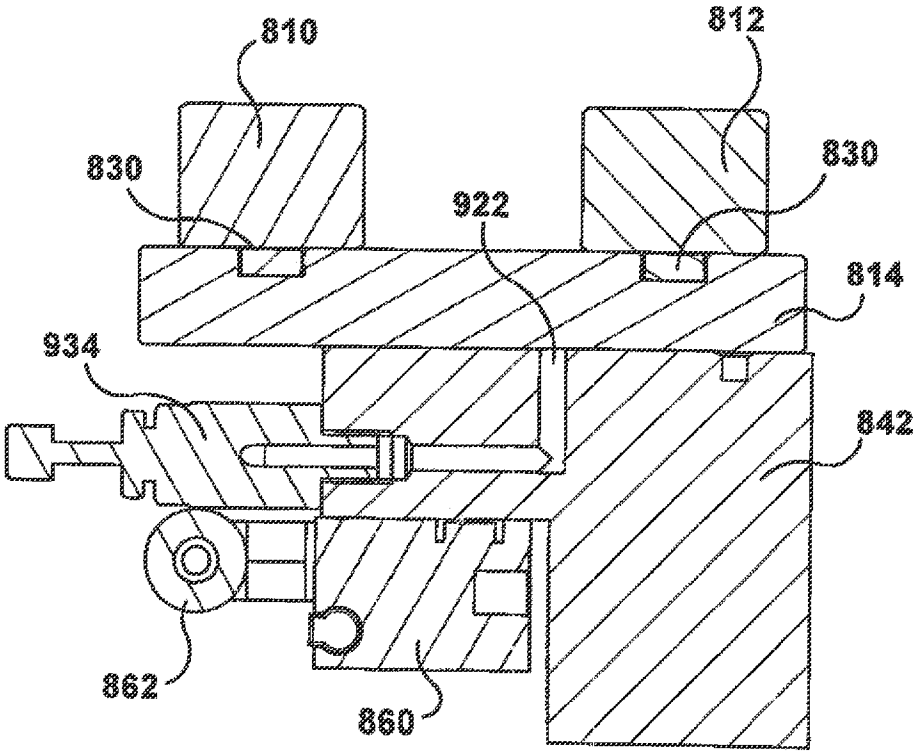
FIG. 40 is a view as seen from the plane defined by the line 40-40 in FIG. 30.
Figure 41:
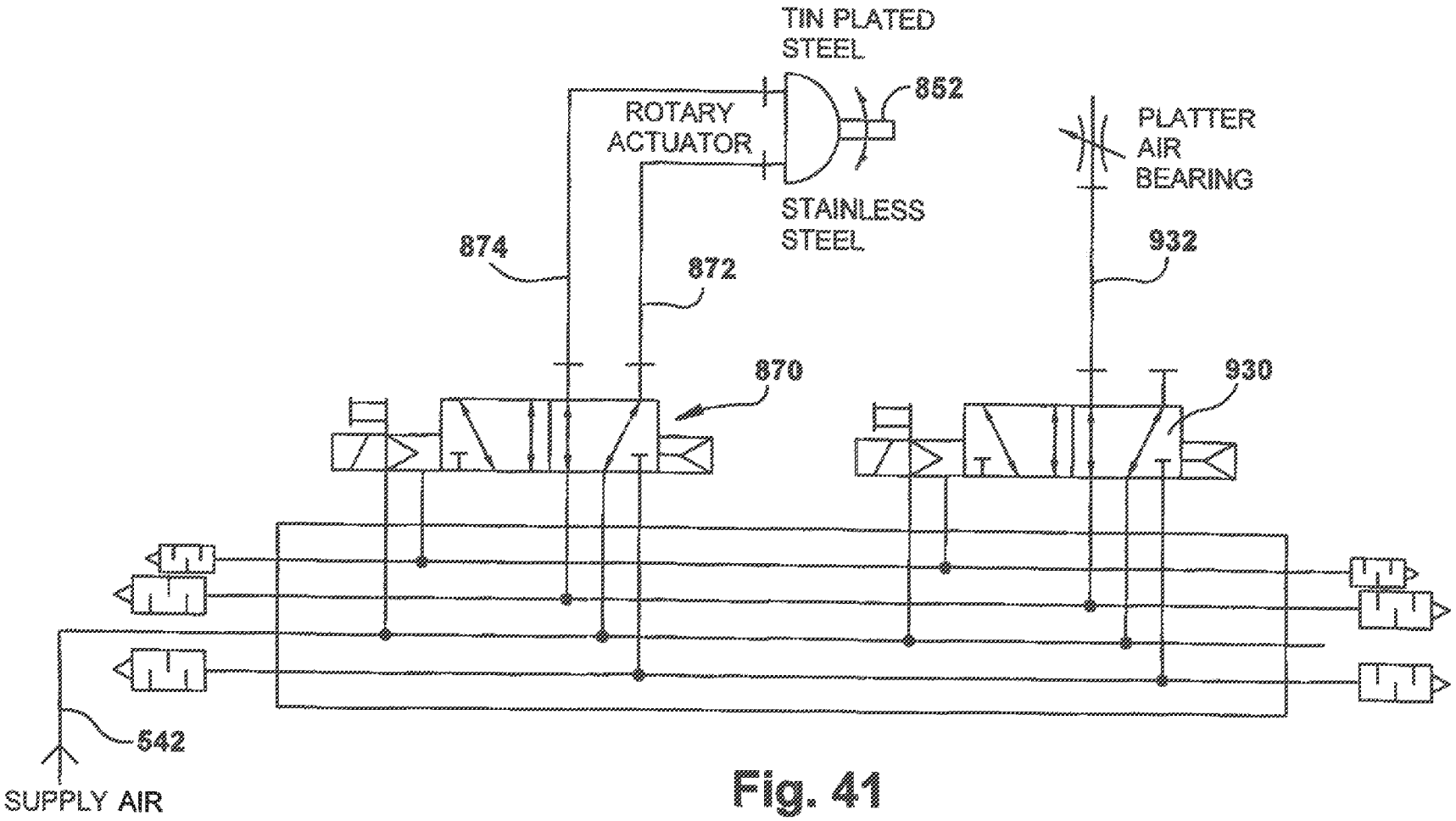
FIG. 41 is a schematic of a flow control used in re-orienting the stop assembly to position a controlled one of the stops of a stop assembly.

The rotatable stop body 814 is generally disk shaped. Extending downwardly from a bottom surface of the rotatable stop body is a stem 886 having an outer surface that fits into a sleeve bearing 888 supported within a generally cylindrical through passage 890 of the stop support body 842. When assembled, conforming surfaces or faces 910, 912 of the rotatable stop body 814 and the stop support body 842 are in contact with each other along a generally planar interface. The stop support body 842 defines a fluid passageway extending from an inlet port 920 on a side face of the stop support body 842 to an outlet port 922 (as seen in FIGS. 32 and 40) opening that faces the conforming surface of the rotatable stop body. When air under pressure is forced from the outlet port 922, a cushion of air (or air bearing) is created between the rotatable stop body and the support body, thereby reducing a frictional engagement between the two. This reduction in the force of engagement allow movement of the piston 844 to re-oriente the rotatable stop body 814 and position a different stop in the path of travel of the die support. FIG. 41 depicts a valve 930 for routing pressurized air from the air source through a conduit 932 to a fitting 934 attached to the body and through the internal passageway to the outlet port 922 in response to a control signal from the control 120.

Figure 26:
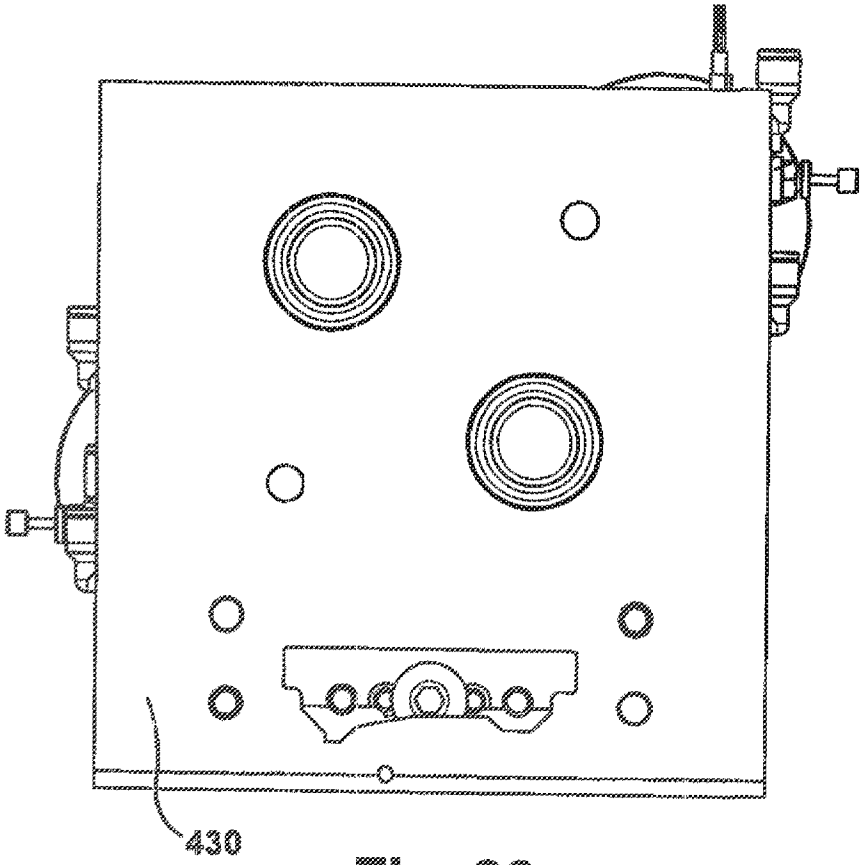
FIG. 26 is a bottom plan view of an anvil support.
Figure 25:
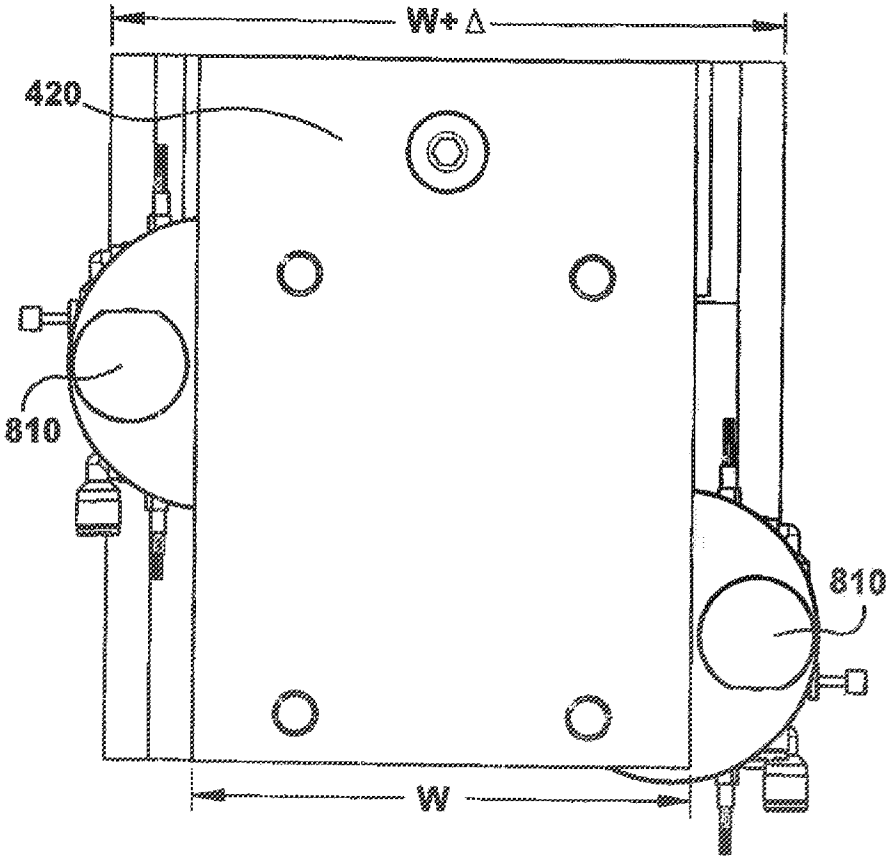
FIG. 25 is a top plan view of a die support.
Figure 28:
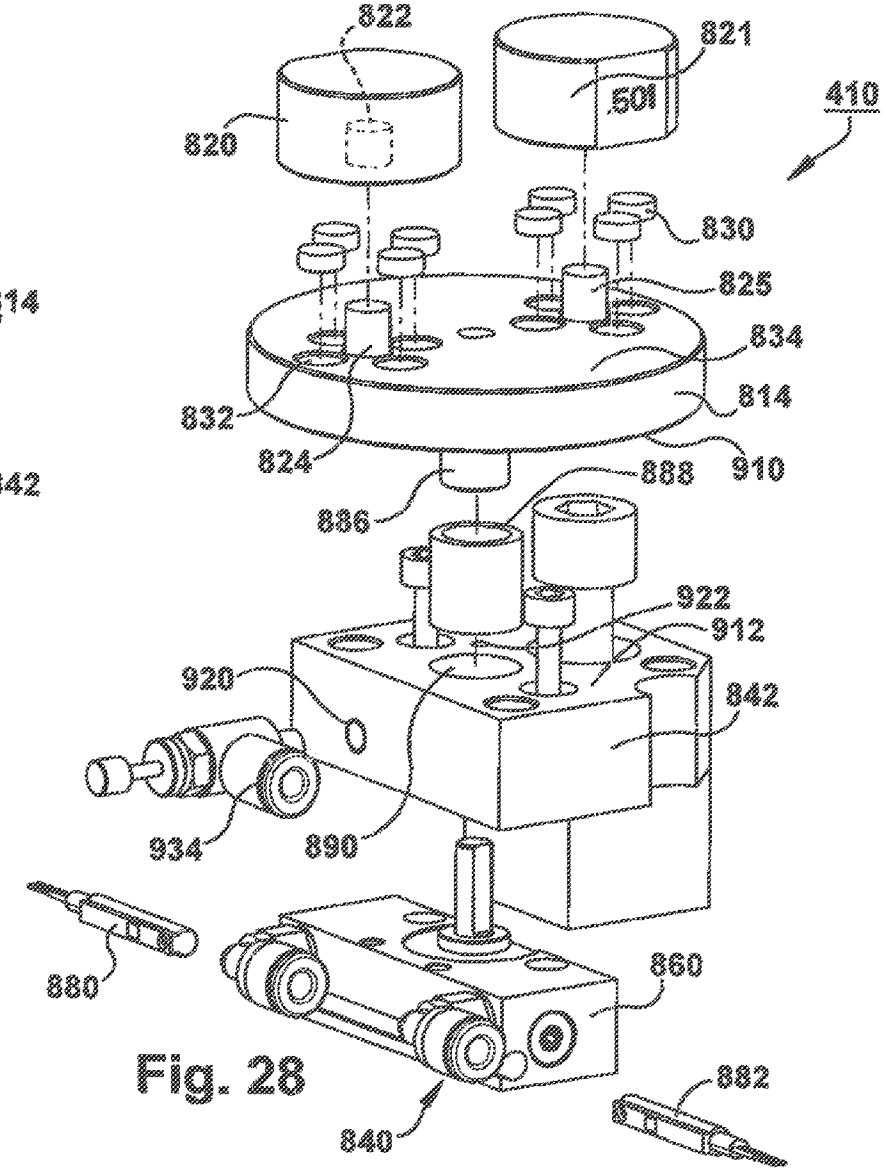
FIG. 28 is an exploded perspective view of the stop assembly of FIG. 27.

FIGS. 25 and 26 are a top plan view of the moveable die support 420 (FIG. 25) and a bottom plan view of the moveable anvil support 430 (FIG. 26). As seen in FIG. 25, the die support has a width W and the anvil support has a width W+Δ. In the Exemplary embodiment the width W is 4.250 inches AND W+Δ is 5.750 inches. As mentioned above two stop assemblies 410 are mounted to an associated anvil support on each side of the strip. As seen in the FIG. 25 depiction the control has rotated two stops 810 having the same height out of the way of the die support. Hence, the two stops 812 that make up the stop assemblies are located in position for limiting die movement due to impact with the die support as that support is driven downward with its associate die.

As explained below, there is a need in flexibility in choosing the height of the removable stops. For a typical system, during set up of the machine, the operator will select two sets of stops (four each) and attach them to the rotatable stop body by fitting them over the stud 824, 825. Then as the strip material changes under the control of the control 120, an appropriate set of two of four stops are rotated into position for limiting die movement on opposite sides of the strip. To facilitate operator set up a dimension marking is stamped onto the sides of the removable stops. Typically, all four stops will have the same height dimension. If drives on the two sides of the strip were not connected (by the drive plate 400 for example) the die movement on opposite sides of the strip may for a given punch be controlled with different dimension stops.

In the exemplary embodiment the punch drives for moving the plate 400 are air actuated drives. The exemplary system limits movement of the dies in a somewhat empirical fashion to achieve a best result of corner fabrication. The correct amount of energy is determined by the use of a fold force gage. A goal is to achieve the same fold force regardless of material, and make the adjustments to the stop height dimension T to achieve that goal.

An alternate example embodiment of the punch station 104 is depicted in FIG. 8. This station has two dedicated stamping stations for forming the corners 32*a*, 32*b*, 32*c*, 32*d*. Two stamping stations 148, 148' are capable of stamping the three corners 32*b*, 32*c*, 32*d* that are separated from the tongue. And the two stamping stations 150, 150' are capable of stamping the corner 32*a*. For one material, stainless steel for example, the stations 148, 150 are set up for forming the corners. If a demand for tin plated steel frames is subsequently being satisfied (by the control station 120 choosing an appropriate supply roll at the stock supply station 102 for feeding through the line) the control station forms the corners by selective actuation of a second set of stamping stations 148', 150' that deform the strip in a slightly different manner.

Figure 16A:
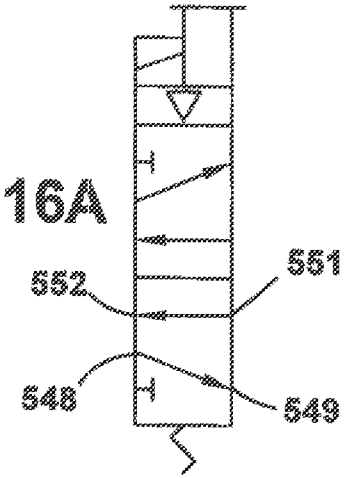
FIGS. 16 and 16A are a pneumatic schematics showing solenoid valves that selectively supply air to air actuated cylinders at the punch station.
Figure 16:
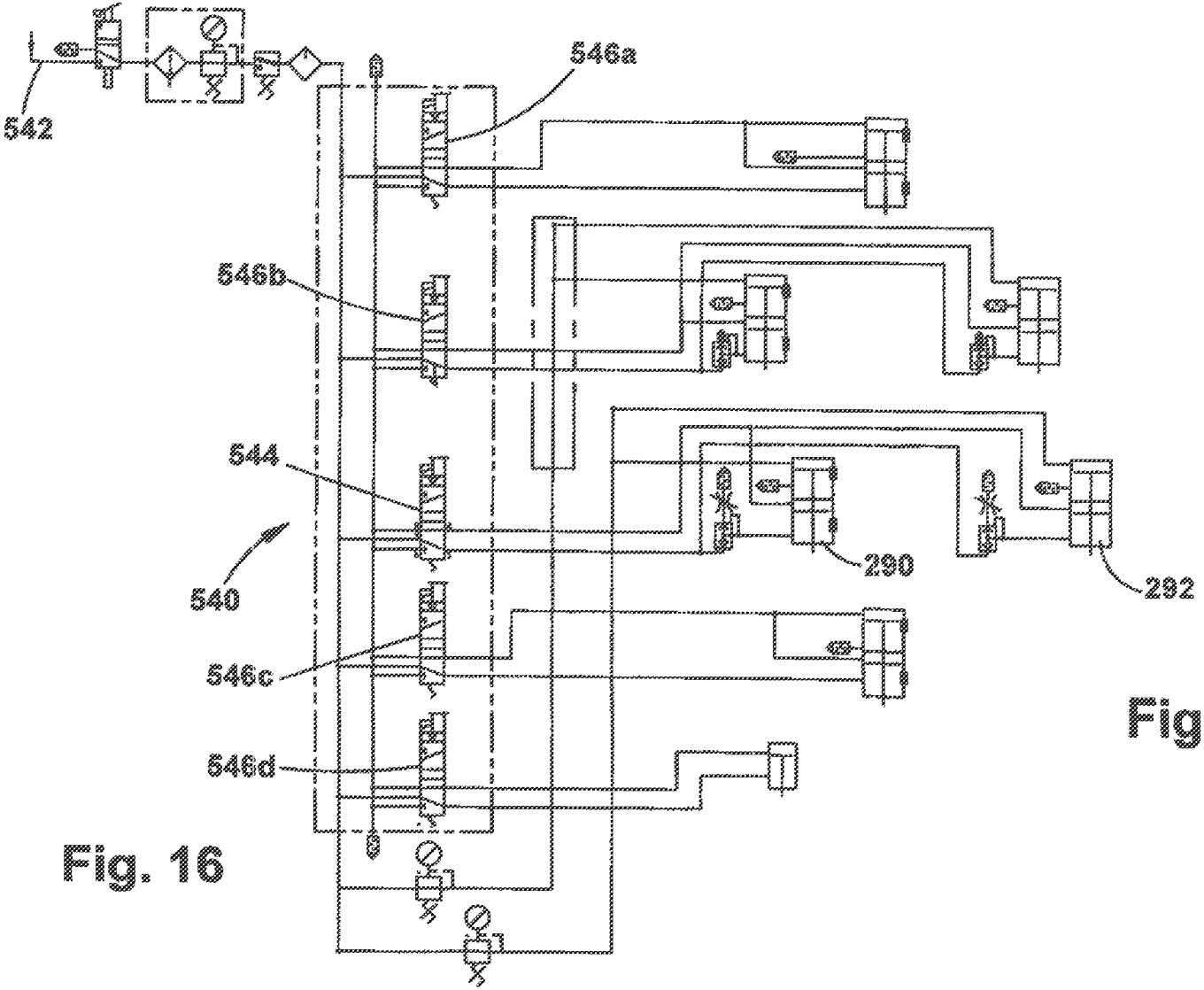

FIG. 16 is a schematic depiction of a pneumatic system 540 for pressurizing the dual acting air cylinders 290, 292 at the punching station 104. The two air cylinders 290, 292 are coupled to the air source 542 through a solenoid operated valve 544 that delivers air at 80 psi to the air cylinders having a piston of ⅝ inch diameter and a throw distance of ⅝ inch. The solenoid 544 responds to control outputs from the control 120 by switching back and forth from a position in which the plate 400 is raised and a position which forces the plate downwardly to notch the strip S. Other solenoid operated valves 546*a*, 546*b*, 546*c*, 546*d* are also depicted in FIG. 16. The ports for the valve 544 are labeled in detail in FIG. 16A wherein port 1 has been labeled with reference character 548, port 2 with reference character 549, port 3 labeled with reference character 551 and port 4 with reference character 552.

Figure 17:
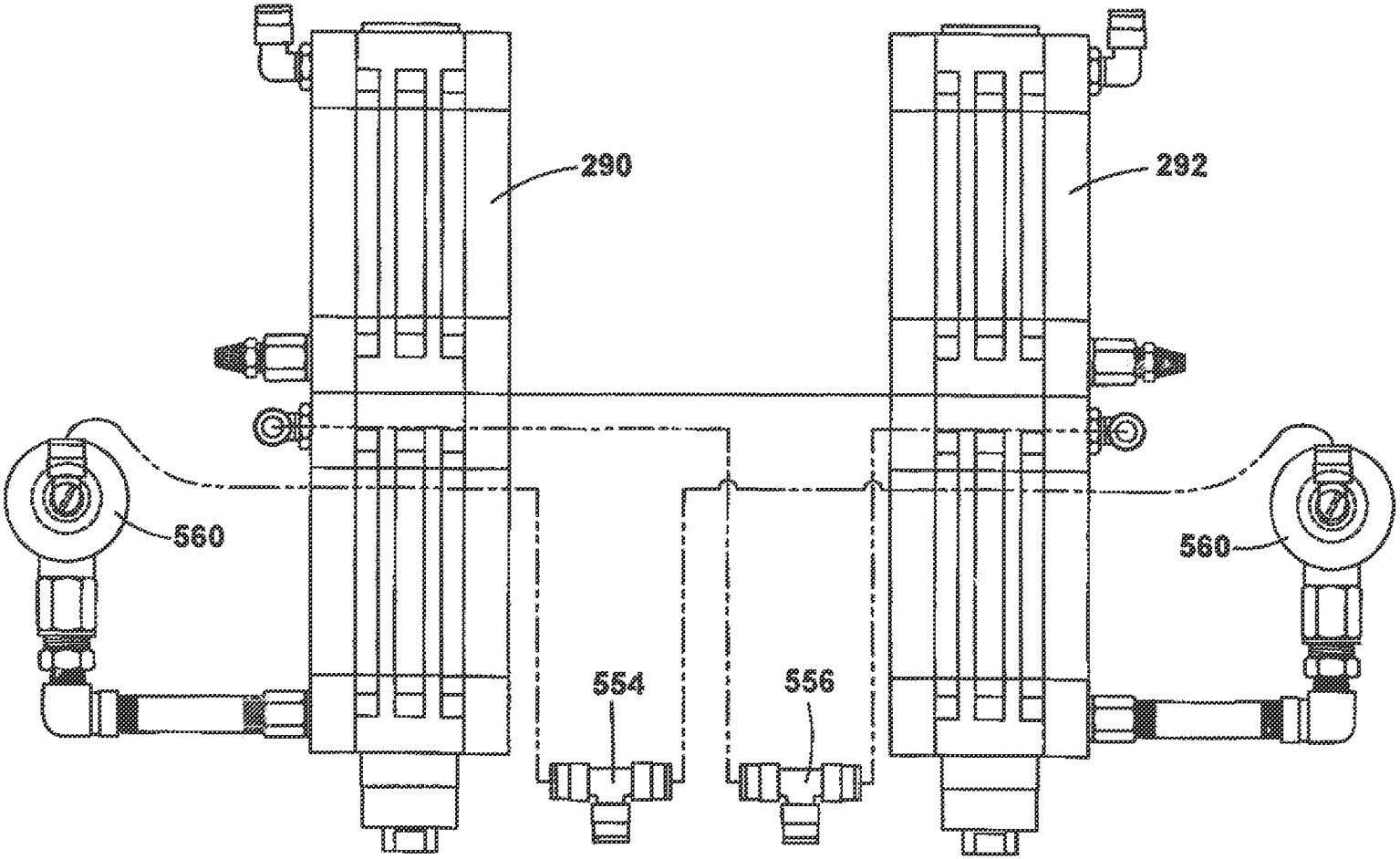
FIG. 17 is a schematic showing two air actuated cylinders for forming corners that have a flow control valve that limits a rate of air escaping a pressured chamber of the cylinder.
Figure 18:
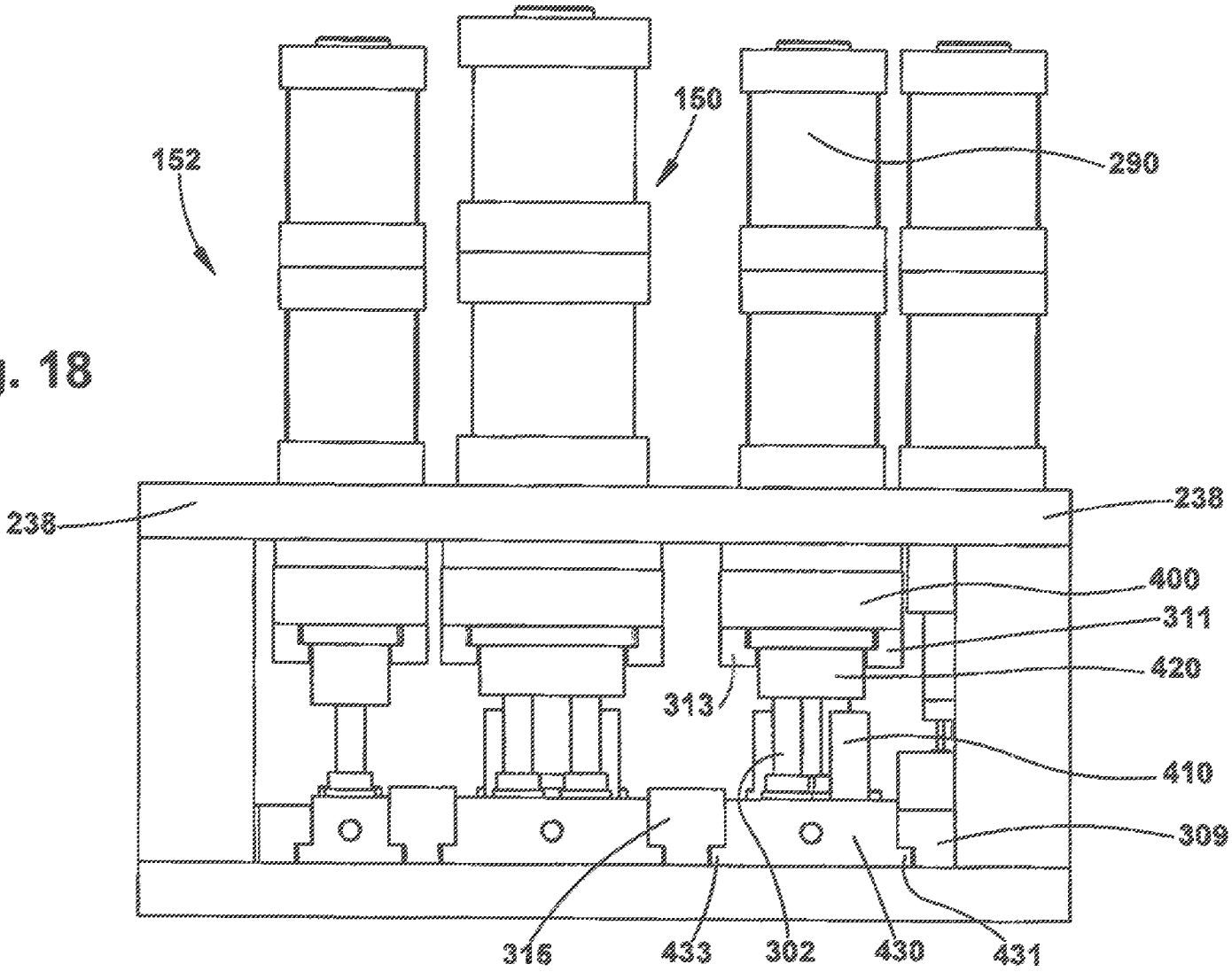
FIG. 18 is a side elevation view showing support structure for a moveable die and anvil.

Turning to FIG. 17, one sees the connections to the two air driven cylinders 290, 292 in more detail. A pair of T connectors route air passing through the solenoid valve 544 to the cylinders. A first T connector 554 is connected to port number 2 on the solenoid valve 544. When pressurized air is provided by this port, the cylinders lift the plate 400 up against the action of gravity. When a second T connector 556 receives pressured air from port number 4 of the valve 544 the cylinders drive the plate 400 downwardly in a controlled manner. This arrangement allows one connector (554 for example) to pressurize one of the internal air cylinder chambers of both air cylinders 290, 292 while another chamber of the cylinder is vented or exhausted through the other connector (556 for example) through the solenoid valve and then to atmosphere.

In the exemplary embodiment, the two air cylinders 290, 292 are connected to an improved quick exhaust 560 (FIG. 17) available from Festo as part number SE-1/2-B. As described in US published application 2012/0011722, the quick exhaust 560 has a threaded exhaust port. A flow control is threaded into the exhaust port of the quick exhaust. The flow control has an integrated sintered silencer. An exemplary flow control is available from Festo as part number GRE-1/2. A goal of use of the flow control is to not noticeably slow the speed of the dies but improve the consistency of the strikes by the die against the strip. Stated another way, the flow control allows for a known or regulated control of the exhausts to allow for a substantially repeatable load force applied to the strip S by the dies and anvils of the punch station 104.

A study of the operation of the corner notching has led to a better understanding of how various factors affect corner fold quality. Generally, after a production line is converted from Tin Plate to Stainless Steel a range of fold force (forming the 90 degree angle between spacer frame segments 30 shown in FIG. 1) readings vary by about 5 oz. That is, the force needed to bend the severed frame from its original elongated linear strip form to a closed form vary over a range of about 5 oz for both stainless steel and tin plated steel. It has been found that after an extended period of use the fold force experienced can often have a range of over 10 oz. This difference is attributed to changes in the system over time such as clogged flow paths in the pneumatic circuit coupled to the cylinders 290, 292 and to structural wear in the components forming the punch station 104, such as the guide rods 302. As the components wear, the system friction is reduced. This reduced friction results in inconsistent acceleration of the dies.

The die stroke is about ⅜ inch. The travel time from an up limit switch signal to a down limit switch signal is about 7 milliseconds. These limit switches are attached to the air cylinder body and detect when an inner piston is up (retracted) or/down (extended) position. During this 7 millesec time the acceleration and final velocity of the dies (in the downward punch direction) is affected by several factors. Gravity is accelerating the dies. Friction is resisting the acceleration. Air pressure coming into the cylinders is accelerating the load. Air pressure on the exhaust side of the cylinder is resisting acceleration. The shearing force required to notch the strip is trying to stop the load.

Gravity is a constant. Its force will not change over time. Friction is substantially consistent over a relatively short time period. However, friction will change to some degree over time as wear takes place. Friction may also be sharply increased or decreased with press alignment and die binding. Adjustments to the press can be made which inadvertently apply a mechanical bind to the system. Air flow in and out of the cylinders will also be fairly consistent over a short time period. Air flow characteristics however can change dramatically over time. This change is experienced as mufflers or silencers become plugged, air flow is restricted.

When the air supply to the punch station 104 is removed, the dies will fall due to gravity. If the air supply is toggled on and off several times and one observes how the dies fall, one will see some variation in the manner in which the dies fall. Sometimes the die will fall quickly, and sometimes they may fall slower. In some cases they may only fall part way, pause and then fall the rest of the way. Using pneumatics to consistently accelerate a load that will freefall, leads to some small variations. Since air is a compressible fluid, small changes in external conditions such as mechanical binding or air flow restrictions can result in noticeable changes in the consistent delivery of energy to the punch driver system. Adding the flow control after the quick exhaust achieves much greater consistency in both time and load applied to the strip S by the dies.

Set up of the flow control is to some degree empirical but can be simplified if the actual force of engagement between the die and the strip S is measured. This can be performed using a force gauge commercially available from GED Integrated Solutions Inc., assignee of the present invention. (part number 2-24472) The Exemplary flow control has an adjustment feature that is adjusted by turning a screw. The flow control has a tapered cone spaced from a mechanical seat. The closer the cone is to the seat, the more restricted is the airflow, on the control, the flow path through the control can be adjusted for maximum flow. Best results are obtained if the flow is somewhat restricted however, so that in one exemplary system best results were obtained by rotating the screw three turns, resulting in approximately 30% reduction in flow. The exemplary flow controls have about 10 full turns (360 degrees) from open to closed, so 3 turns from open would be about 30% restriction. The data in Table 1 below was obtained at this setting and measures the actual measured force applied to a gauge in ounces for twelve readings. Note the range from the maximum to the minimum is only 5 ounces compared to values measured of as much as 12 ounces for a non flow restricted exhaust. This data is obtained by using the 2-24472 fold force gauge.

TABLE 1

| Flow restricted Corner 1 | Corner 2 | Corner 3 | | |
|---|---|---|---|---|
| 48 | 53 | 48 | Minimum | 48 |
| 48 | 51 | 48 | Maximum | 53 |
| 49 | 50 | 48 | Range | 5 |
| 48 | 51 | 49 | Average | 49 |

Crimper Station 108

A crimper assembly is connected to an output end of the roll former station 106 and processes roll formed strip 312 output from the roll former 210 and is described in detail in issued U.S. Pat. No. 7,448,246.

The crimper assembly includes two horizontally oriented pneumatically actuated cylinders having crimping fingers attached to the output drive rods of these cylinders. The crimping fingers are located so that their center line of action extends parallel to and intersections a region between the center lines of rotation of the rollers. When the cylinders are extended the crimp fingers strike the corners or leads at their center.

Figure 13:
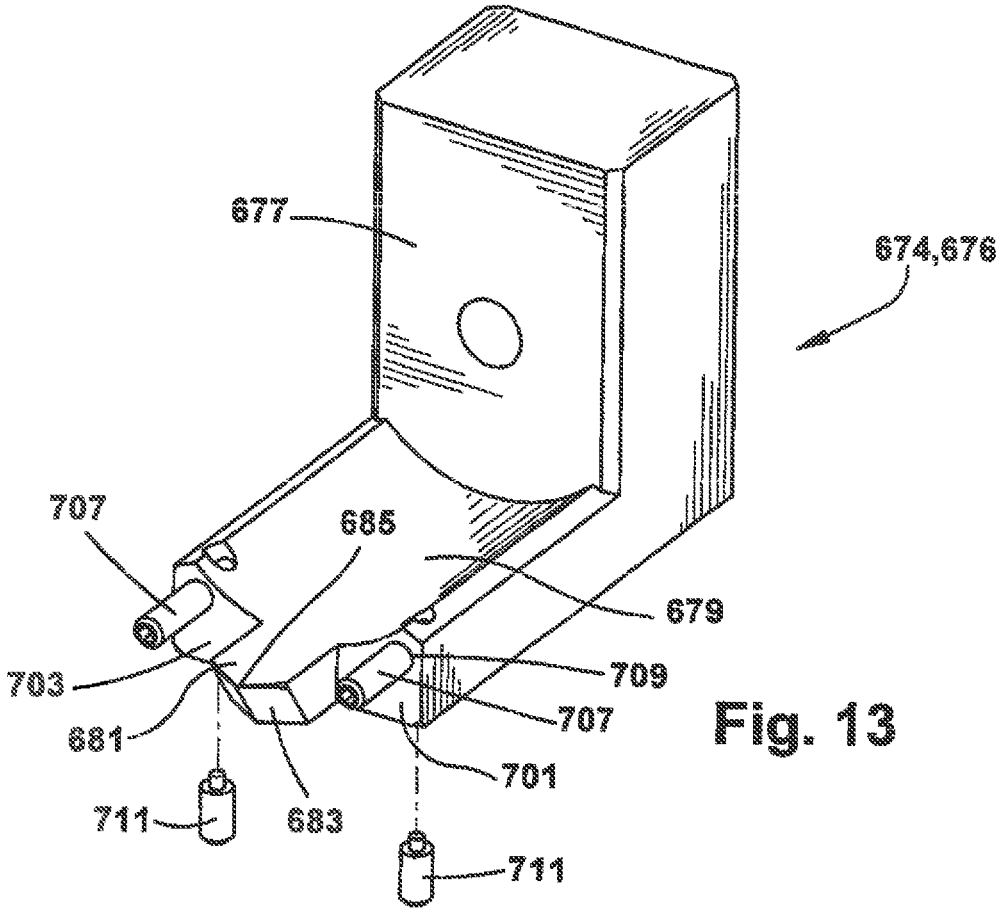
FIG. 13 is a perspective view of a crimping finger.
Figure 14:
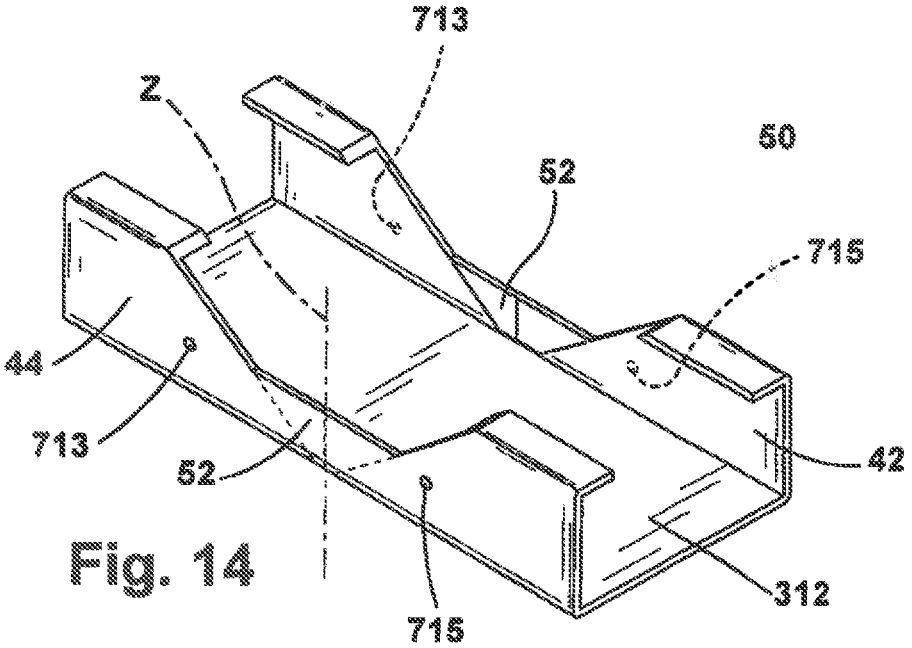
FIG. 14 is a perspective view of a section of strip stock after it has been passed through a roll former.

FIG. 13 is a perspective view of a crimping finger. A threaded opening in a mounting block allows the finger to attach to the output of a drive cylinder. In one example embodiment, the crimping fingers are made from a tool steel or flame hardened steel as would be appreciated by one of ordinary skill in the art.

A v-shaped contact 681 has a beveled underside 683 which extends from a concave shaped portion 679 of the fingers 674, 676. Top portion of the contact 681 comes into contact with the lateral walls 42, 44 of the frame structure 16 (see FIG. 1) initially and continued movement of the fingers bring the beveled underside 683 into engagement with the frame to crease the frame in the region of weakness 52 at the notch 50.

The contact 681 further comprises an apex 685 extending to the contact's most distal point. The concave portion 679 includes two faces 701, 703, transversely located with the concave portion and spaced apart by the contact 681. The faces 701, 703 terminate at a proximal end of the contact 681. A cylindrical boss 707 extends from each of the faces 701 and 703 beyond the apex 685 of the contact 681. The cylindrical bosses 707 are received and supported by a cylindrical support opening 709 located hi respective faces 701, 703 and extend beneath the concave portion 679 of the fingers 674, 676.

Securing the bosses 707 into the respective support openings 709 are respective fasteners 711. In one example embodiment, the fasteners 711 are socket head set screws. In another example embodiment, the cylindrical bosses 707 are supports sold by GED Integrated Solutions under part number 758-0220.

During operation, an apex 685 of the fingers centrally engages (along the z axis of FIG. 21) the area of weakness 52 by the apex 685, which continues to a prescribed first depth along the x axis of both lateral walls 42, 44 of the frame 16. Once the first prescribed depth is reached, the cylindrical bosses 707 contact symmetrically at first and second points 713, 715 about the area of weakness the lateral walls 42, 44. This removes contact between the lateral walls and apex 685, while continuing the deformation of the respective lateral wall near the region of weakness 52 along the x axis to a second depth. Both the first and second prescribed depths occur in a single advancement of both fingers during a single cycle. In one example embodiment, the difference between the first prescribed depth and the second prescribed depth is 0.030 inches.

While an exemplary embodiment of the invention has been described with particularity, it is the intent that the invention include all modifications from the exemplary embodiment falling within the spirit or scope of the appended claims.

The invention claimed is:

1. Apparatus for fabricating spacer frames from strip stock of different material for use in an insulating glass unit, said apparatus including multiple work stations for treating an elongated strip of said strip stock as the elongated strip moves through successive work stations comprising:

a) a punching station having a punch drive that moves a die into engagement with a flat surface of the elongated strip at controlled locations along a length of said elongated strip to form corner locations that facilitate bending of the elongated strip into a closed multi-sided structure, wherein the punching station has an adjustable stop with multiple stop surfaces that can be rotated into an engagement position that limits movement of the die into the elongated strip to a controlled amount;

b) a forming station that forms a spacer frame from the elongated strip having side walls to which an adhesive is applied during fabrication of an insulated glass unit;

c) a severing station that separates a lead spacer frame from subsequent spacer frames after the lead frame has moved through the punching and forming stations; and d) a control station that adjusts energy transferred during engagement between the die and the elongated strip at the punching station by rotating a selected one of the multiple stop surfaces into the engagement position.

2. The apparatus of claim 1 wherein the adjustable stop includes a stop body and a stop body support mounted in relation to a path of travel of the elongated strip wherein the stop body defines first and second different movement limiting stop surfaces located on different regions of the stop body wherein the adjustable stop further comprises and further comprising a fluid source and a stop actuator responsive to the fluid source rotates the stop body relative to the stop body support to position a selected limiting stop surface in the engagement position which limits movement of the die during a punch stroke of the die.

3. The apparatus of claim 2 wherein the die is supported by a die support having a generally planar contact surface which moves in response to controlled actuation of the punch by the control station and wherein the die support contact surface engages a movement limiting surface of the selected limiting stop surface positioned in the engagement position.

4. The apparatus of claim 2 wherein the stop actuator comprises a drive piston having first and second ends having a drive gear extending along a length of the drive piston, and an output shaft coupled to the stop body for rotating the stop body and including a driven gear that engages the drive gear of said piston to impart rotational movement to the output shaft in response to movement of said piston.

5. The apparatus of claim 4 wherein the actuator has an actuator body having pressure conveying passageways for conveying air under pressure through the passageways to opposed ends of piston for imparting back and forth movement to the piston which in turn is converted to back and forth rotation of the output shaft of the stop actuator.

6. The apparatus of claim 5 wherein the stop body is generally disk shaped and wherein conforming surfaces of the stop body and the stop body support are generally planar, further wherein the stop body support comprises a passageway leading to a port facing the conforming surface of the stop body for reducing a force of engagement between the stop body and the stop body support to allow rotation of the stop surfaces of the stop body.

7. The apparatus of claim 2 wherein the stop body comprises a plurality of magnets and a positioning post for each of a number of different dimension removable stops that fit over a respective positioning post and are held in place by the magnets.

8. The apparatus of claim 1 wherein the punching station comprises first and second dies mounted to die supports on opposite sides of the elongated strip that forms corner locations on opposed regions of the elongated strip and further wherein the punching station comprises adjustable stops on each side of the elongated strip for limiting movement of each of said dies.

9. Apparatus for fabricating elongated spacer frames from strip stock including multiple work stations for treating strip stock as an elongated strip of the strip stock moves through the multiple work stations comprising:

a) punching station having a punch drive that moves a die into contact with a flat surface of the strip stock at controlled corner locations along a length of said elongated strip and an adjustable stop that can be rotated into an engagement position that limits movement of the punch drive to control engagement between the elongated strip and the die; said adjustable stop comprising a stop body having first and second stop body contact regions, a stop body support, a source of compressed air that routes air into a region between the stop body and the stop body support to lessen a force of engagement between the stop body and the body;

b) a forming station that bends the strip into a desired shape;

c) a severing station that separates a lead spacer frame from subsequent spacer frames after the lead spacer frame has moved through the punching and forming stations; and d) an actuator that moves the stop body relative to the stop body support to position a selected one of the stop body contact regions into an engagement position to limit movement of said die.

10. The apparatus of claim 9 wherein the punching station comprises:

a) a first die assembly supporting a first die that deforms one side of the elongated strip;

b) a second die assembly supporting a second die that deforms an opposite side of the elongated strip;

c) a ram assembly including the punch drive coupled to the first and second die assemblies that drives the first and second dies into engagement with the elongated strip; and d) wherein said adjustable stop limits movement of the ram assembly.

11. The apparatus of claim 10 wherein the punching station comprises first and second anvils defining a slot which accommodates movement of the elongated strip through the punching station and further comprising a sharp edged ridge on the first and second dies which help deform the elongated strip when the elongated strip is impacted between the die and the anvil.

12. The apparatus of claim 11 comprising first and second adjustable stops on opposite sides of the strip path of travel which are contacted by the ram assembly to control deformation of the elongated strip by the first and second die assemblies.

13. The apparatus of claim 10 wherein the punch drive comprises an air actuated drive and wherein the pressure supplied to the air actuated drive is adjusted to control deformation of said elongated strip by the punching station.

14. Apparatus for fabricating spacer frames for use in an insulating glass unit, said apparatus including multiple work stations for treating an elongated strip as the elongated metal strip moves through successive work stations along a strip path of travel comprising:

a) a punching station comprising:

i) a punch drive that moves a die into engagement with a flat surface of the metal strip at controlled locations along a length of metal elongated strip to form corner locations that facilitate bending of the elongated strip into a closed multi-sided structure; and ii) an adjustable stop comprising a stop body and stop body support mounted in relation to the strip path of travel wherein the stop body defines first and second different movement limiting stop surfaces located on different regions of the stop body that can be rotated into an engagement position that limits movement of the die to a controlled amount that depends on a type of material of the elongated strip passing through the punching station;

b) a roll forming station that bends the elongated strip to form spacer frame side walls to which an adhesive is applied during fabrication of an insulated glass unit;

c) a severing station that separates a lead spacer frame from subsequent spacer frames after the lead spacer frame has moved through the punching and roll forming stations; and d) a control station that adjusts energy transferred during engagement between the die and the elongated strip at the punching station comprising a stop actuator that rotates a selected one of the movement limiting stop surfaces into the engagement position.

15. The apparatus of claim 14 further comprising a fluid source and wherein the stop actuator is responsive to the fluid source that rotates the stop body relative to the stop body support to position a selected one of the limiting stop surfaces in an engagement position limits movement of the die during a punch stroke of the punch drive.

16. The apparatus of claim 15 wherein the die is supported by a die support having a generally planar contact surface which moves in response to controlled actuation of the punch drive by the control station and wherein the die support contact surface engages one of the movement limiting stop surfaces of the adjustable stop positioned in the engagement position.

17. The apparatus of claim 15 wherein the stop actuator comprises a drive piston having first and second ends having a drive gear extending along a length of the drive piston, and an output shaft coupled to the stop support for rotating the stop support and including a driven gear that engages the drive gear of said piston to impart rotational movement to the output shaft in response to movement of said piston.

18. The apparatus of claim 17 wherein the stop actuator has an actuator body having pressure conveying passageways for conveying air under pressure through the passageways to opposed ends of the drive piston for imparting back and forth movement to the drive piston which in turn is converted to back and forth rotation of the output shaft of the stop actuator.

19. The apparatus of claim 18 wherein the stop body is generally disk shaped and includes a generally planar surface facing a conforming surface of the stop body support, further wherein the stop body support comprises a passageway leading to a port facing the generally planar surface of the stop body for reducing a force of engagement between the stop body and the stop body support to allow reorientation of the stop surfaces of the stop body.

20. The apparatus of claim 14 wherein the stop body comprises a plurality of magnets and one or more positioning posts for mounting different dimension removable stop bodies having recesses that fit over a respective positioning post and are held in place by the magnets.

21. The apparatus of claim 16 wherein the punching station comprises first and second dies mounted to die supports on opposite sides of the strip for forming corner locations on opposed regions of the strip and wherein first and second stop bodies are mounted to the stop body supports on each side of the strip for limiting movement of said first and second dies.

22. The Apparatus of claim 16 comprising:

a source of compressed air for routing air into a region between the stop body and the stop body support to lessen a force of engagement between the stop body and the body.

23. The apparatus of claim 22 wherein the punching station comprises:

a) a first die assembly supporting a first die for deforming one side of the strip;

b) a second die assembly supporting a second die for deforming an opposite side of the elongated strip;

c) a ram assembly including the punch drive coupled to the first and second die assemblies for driving the first and second dies into engagement with the elongated strip; and d) first and second adjustable stops for limiting movement of the first and second dies.

24. The apparatus of claim 23 wherein the punching station comprises first and second anvils defining a slot which accommodates movement of the elongated strip through the punching station and further comprising a sharp edged ridge on the first and second dies which help deform the elongated strip when the elongated strip is impacted between the die and the anvil.

25. The apparatus of claim 24 wherein the first and second adjustable stops are contacted by the ram assembly to control deformation of the strip by the first and second die assemblies.

26. The apparatus of claim 23 wherein the punch drive comprises an air actuated drive and wherein the pressure supplied to the air actuated drive is adjusted by said control station.

* * * * *